US010716361B2

(12) United States Patent
Nordstrom

(10) Patent No.: US 10,716,361 B2
(45) **Date of Patent: *Jul. 21, 2020**

(54) ARTICLE OF FOOTWEAR WITH ONE OR MORE AUXETIC BLADDERS

(71) Applicant: NIKE, Inc., Beaverton, OR (US)

(72) Inventor: Matthew D. Nordstrom, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 189 days.

This patent is subject to a terminal disclaimer.

(21) Appl. No.: 15/825,473

(22) Filed: Nov. 29, 2017

(65) Prior Publication Data

US 2018/0077998 A1 Mar. 22, 2018

Related U.S. Application Data

(63) Continuation of application No. 14/503,506, filed on Oct. 1, 2014, now Pat. No. 9,854,869.

(51) Int. Cl.

| | |
|---|---|
| ***A43B 13/14*** | (2006.01) |
| ***A43B 13/18*** | (2006.01) |
| ***A43B 13/20*** | (2006.01) |
| ***A63B 71/08*** | (2006.01) |
| *A63B 71/12* | (2006.01) |

(52) U.S. Cl.

CPC ..... *A43B 13/20* (2013.01); *A43B 13/14* (2013.01); *A43B 13/181* (2013.01); *A43B 13/187* (2013.01); *A63B 71/081* (2013.01); *A63B 2071/1258* (2013.01)

(58) Field of Classification Search

CPC ..... A43B 3/0036; A43B 13/14; A43B 13/181; A43B 13/187; A43B 13/20

USPC ..... 36/25 R, 29, 35 B

See application file for complete search history.

(56) References Cited

U.S. PATENT DOCUMENTS

| | | | | |
|---|---|---|---|---|
| 1,869,257 | A * | 7/1932 | Hitzler | A43B 17/03 36/3 R |
| 2,580,840 | A * | 1/1952 | Rogndal | A43B 13/223 36/29 |
| 5,755,001 | A * | 5/1998 | Potter | A43B 21/28 12/142 P |
| 8,084,117 | B2 * | 12/2011 | Lalvani | B32B 3/266 428/135 |
| 8,544,515 | B2 * | 10/2013 | Ma | B60C 7/14 152/151 |
| 9,375,041 | B2 * | 6/2016 | Plant | A41D 13/0156 |
| 2007/0093768 | A1 * | 4/2007 | Roe | A61F 13/4902 604/369 |
| 2009/0151195 | A1 * | 6/2009 | Forstrom | A43B 13/20 36/29 |
| 2009/0178301 | A1 * | 7/2009 | Dojan | A43B 13/20 36/29 |
| 2009/0276933 | A1 * | 11/2009 | Dodd | A41D 13/0153 2/16 |

(Continued)

*Primary Examiner* — Sharon M Prange

(74) *Attorney, Agent, or Firm* — Quinn IP Law

(57) ABSTRACT

An article of footwear with a midsole has an auxetic bladder member formed from inflated components surrounding star-shaped apertures. The inflated components form one or more auxetic bladders, and may have a triangular geometry. The inflated components are fluidly connected to adjoining components. Adjoining inflated components are hingedly connected, so that they can rotate with respect to each other in the plane of the midsole.

14 Claims, 27 Drawing Sheets

(56) References Cited

U.S. PATENT DOCUMENTS

| | | | | |
|---|---|---|---|---|
| 2012/0129416 | A1* | 5/2012 | Anand | D04B 21/18 442/306 |
| 2012/0233878 | A1* | 9/2012 | Hazenberg | A43B 13/20 36/29 |
| 2013/0219636 | A1* | 8/2013 | Dojan | A43B 23/0235 12/142 R |
| 2014/0059734 | A1* | 3/2014 | Toronjo | A41D 1/00 2/69 |
| 2014/0101816 | A1* | 4/2014 | Toronjo | A41D 31/02 2/69 |
| 2014/0104816 | A1 | 4/2014 | Takasi et al. | |
| 2014/0109286 | A1* | 4/2014 | Blakely | A41D 31/02 2/69 |
| 2014/0205795 | A1* | 7/2014 | Hu | D04B 21/10 428/116 |
| 2016/0007681 | A1* | 1/2016 | Langvin | A43B 13/026 36/103 |
| 2016/0058121 | A1* | 3/2016 | Langvin | A43B 5/06 36/103 |
| 2016/0174661 | A1* | 6/2016 | Nonogawa | A43B 1/04 36/88 |

* cited by examiner

Prior Art

ARTICLE OF FOOTWEAR WITH ONE OR MORE AUXETIC BLADDERS

CROSS REFERENCE TO RELATED APPLICATIONS

The present application is a continuation of U.S. patent application Ser. No. 14/503,506, filed on 1 Oct. 2014, and published as US 2016/0095385, which is incorporated by reference in its entirety

BACKGROUND

The present embodiments relate generally to articles of footwear that may be used for athletic or recreational activities such as running, jogging, training, hiking, walking, volleyball, handball, tennis, lacrosse, basketball and other similar activities.

Articles of footwear can generally be described as having two primary elements, an upper for enclosing the wearer's foot, and a sole structure attached to the upper. The upper generally extends over the toe and instep areas of the foot, along the medial and lateral sides of the foot and around the back of the heel. The upper generally includes an ankle opening to allow a wearer to insert the wearer's foot into the article of footwear. The upper may incorporate a fastening system, such as a lacing system, a hook-and-loop system, or other system for fastening the upper over a wearer's foot. The upper may also include a tongue that extends under the fastening system to enhance adjustability of the upper and increase the comfort of the footwear.

The sole structure is attached to a lower portion of the upper and is positioned between the upper and the ground. Generally, the sole structure may include an insole, a midsole, and an outsole. The insole is in close contact with the wearer's foot or sock, and provides a comfortable feel to the sole of the wearer's foot. The midsole generally attenuates impact or other stresses due to ground forces as the wearer is walking, running, jumping, or engaging in other activities. The midsole may be formed of a polymer foam material, such as a polyurethane (PU), a thermoplastic polyurethane (TPU) or ethylvinylacetate (EVA), that attenuates ground impact forces. In some cases, the midsole may incorporate sealed and fluid-filled bladders that further attenuate and distribute ground impact forces. The outsole may be made of a durable and wear resistant material, and it may carry a tread pattern to provide traction against the ground or playing surface. For some activities, the outsole may also use cleats, spikes or other protrusions to engage the ground or playing surface and thus provide additional traction.

SUMMARY

This summary is intended to provide an overview of the subject matter of this patent, and is not intended to identify essential elements or key elements of the subject matter, nor is it intended to be used to determine the scope of the claimed embodiments. The proper scope of this patent may be ascertained from the claims set forth below in view of the detailed description below and the drawings.

In one aspect, embodiments of an article of footwear have an upper and a sole structure with a midsole. The midsole has at least one bladder member that has fluidly-connected inflated components that form an auxetic structure. The fluidly-connected inflated components are connected by connecting portions that function as hinges, allowing the inflated components to rotate with respect to each other.

In another aspect, embodiments of the article of footwear include an auxetic midsole that has star-shaped apertures surrounded by inflated components. The inflated components are hingedly connected to each other and fluidly connected to each other to form an inflated auxetic bladder. The inflated triangular components can rotate in a plane of the midsole such that the inflated auxetic bladder can simultaneously curve laterally and curve longitudinally.

In another aspect, embodiments of an article of footwear have an upper, a midsole attached to the upper and an outsole attached to the midsole. The midsole has at least one auxetic portion which contains inflated triangular components surrounding star-shaped apertures. Each inflated triangular component is hingedly connected to at least one adjoining triangular component to form an auxetic structure in which the triangular components can rotate with respect to each other in a plane of the midsole. The triangular components are fluidly connected to each other to form an auxetic bladder.

In another aspect, a bladder member includes fluidly-connected inflated components that form an auxetic structure. The fluidly-connected inflated components are connected by connecting portions that function as hinges, allowing the inflated components to rotate with respect to each other. The bladder member is configured to expand in a first direction and a second direction that is orthogonal to the first direction when the bladder member is tensioned in the first direction.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
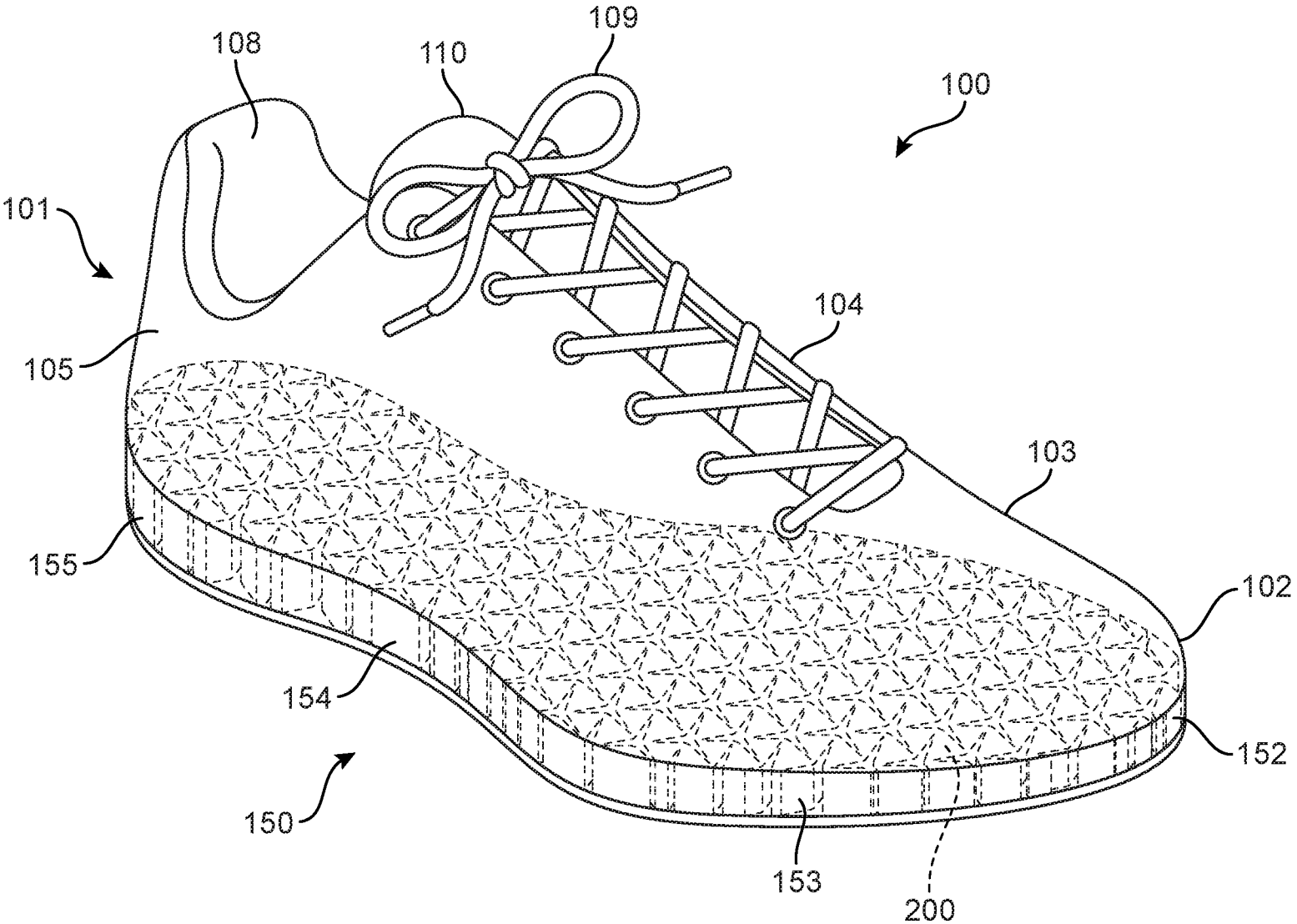
FIG. 1 is a schematic diagram of an embodiment of an article of footwear.

For clarity, the detailed descriptions herein describe certain exemplary embodiments, but the disclosure in this application may be applied to any article of footwear comprising certain of the features described herein and recited in the claims. In particular, although the following detailed description describes certain exemplary embodiments, it should be understood that other embodiments may take the form of other articles of athletic or recreational footwear.

For convenience and clarity, various features of embodiments of an article of footwear may be described herein by using directional adjectives such as top, bottom, medial, lateral, forward, rear, and so on. Such directional adjectives refer to the orientation of the article of footwear as typically worn by a wearer when standing on the ground, unless otherwise noted. The use of these directional adjectives and the depiction of articles of footwear or components of articles of footwear in the drawings should not be understood as limiting the scope of this disclosure in any way.

FIG. 1 is a schematic diagram of a perspective view of an embodiment of an article of footwear that may be used in a number of athletic or recreational activities such as running, walking, training, tennis, volleyball, tennis and racquetball. For reference purposes, upper 101 of article of footwear 100 may be generally described as having a toe region 102, a forefoot region 103, a midfoot region 104 and a heel region 105. Likewise, article 100 includes a sole structure 150 that may generally be described as having a toe region 152, a forefoot region 153, a midfoot region 154 and a heel region 155.

Upper 101 of footwear 100 shown in FIG. 1 may be fabricated from any conventional or nonconventional materials, such as leather, woven or non-woven textiles or synthetic leather. Upper 101 has an ankle opening 108 in upper 101 to allow a wearer to insert his or her foot into the interior cavity of upper 101. The wearer may then use lace 109 to close upper 101 over tongue 110 to fasten the article of footwear over his or her foot. Upper 101 also has a sole structure 150 that is attached to upper 101 by any conventional method, such as stitching, stapling, gluing, fusing or welding or other known method for attaching a sole structure to an upper.

Figure 2:
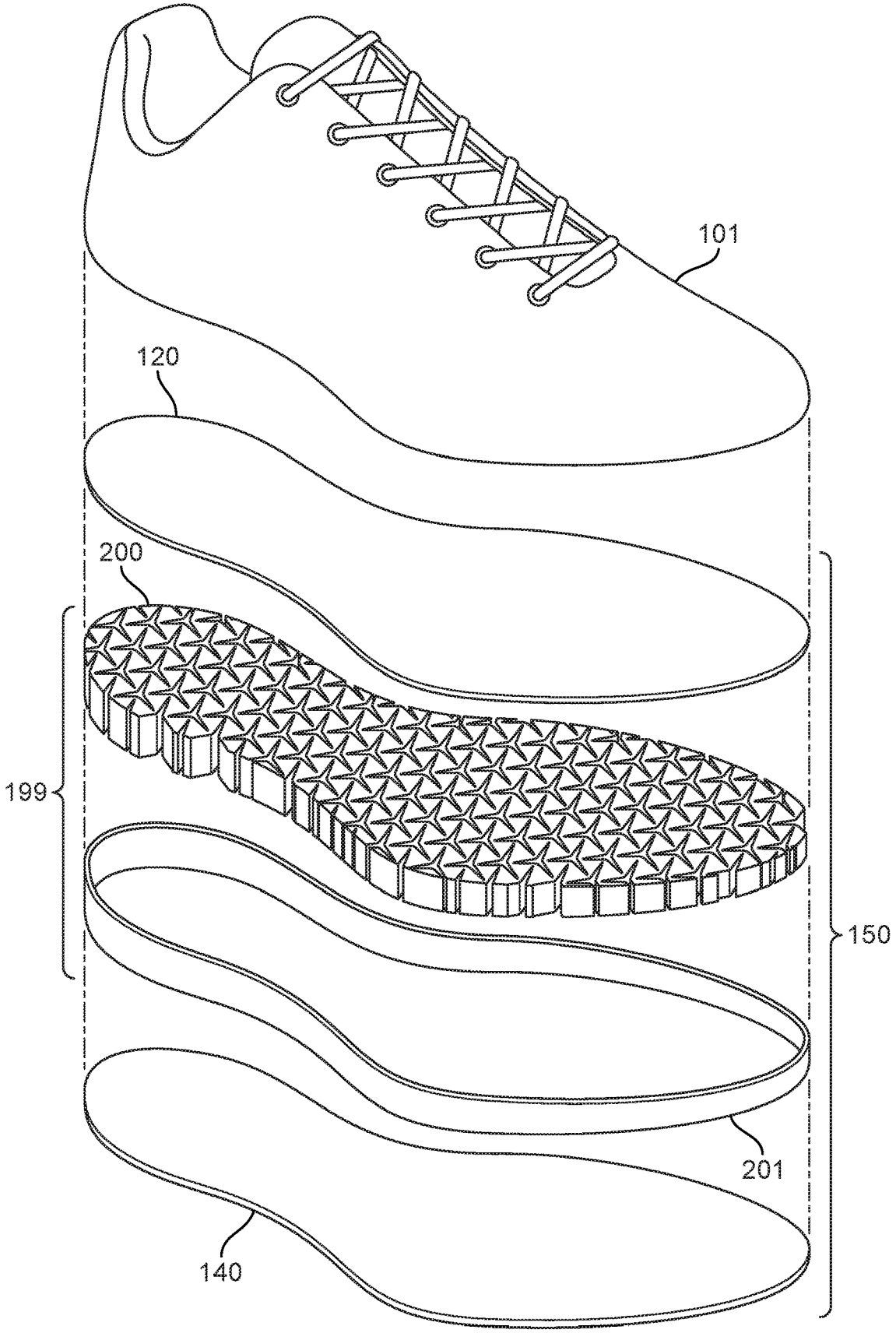
FIG. 2 is a schematic diagram of an exploded view of an embodiment of an article of footwear.

FIG. 2 is a schematic diagram of an exploded view of the embodiment of FIG. 1, showing the primary components of sole structure of article of footwear 100. Sole structure 150 may include insole 120, bladder member 200, midsole perimeter cover 201 and outsole 140. It should be understood that, in some other embodiments, some components of sole structure 150 could be optional. For example, some embodiments may not include insole 120. Likewise, some embodiments may not include midsole perimeter cover 201. In embodiments where insole 120 is used, insole 120 may provide additional comfort to a wearer of the article of footwear.

In the exemplary embodiment of FIG. 2, bladder member 200 and midsole perimeter cover 201 may together comprise a midsole 199. In other embodiments, however, sole structure 150 may include additional midsole components including, for example, one or more layers of foam. In still other embodiments, bladder member 200 may comprise the entirety of the midsole (e.g., the midsole may consist of bladder member 200 alone). Moreover, while the present embodiments contemplate the use of bladder member 200 within the midsole of a sole structure, in other embodiments bladder member 200 could be associated with other components of a sole structure including an outsole and/or an insole.

Midsole 199 attenuates and distributes ground impact forces as a wearer is walking, running, leaping or jumping, for example. The optional midsole perimeter cover 201 may be used to protect bladder member 200 from abrasion or contamination by dirt, debris, water or other contaminants. In some embodiments, perimeter cover 201 may be made of a resilient, flexible and/or stretchable material that does not significantly affect or limit the performance of auxetic bladder member 200. It should be understood that perimeter cover 201 may be used with any of the embodiments disclosed below.

Outsole 140 is the primary ground-contacting component of the article of footwear. Depending upon the particular athletic or recreational activity the article of footwear may be designed for, outsole 140 may have a tread pattern and/or ground engaging devices such as cleats or spikes.

Bladder member 200, as shown in FIG. 2 and as described above, has an auxetic structure. Articles of footwear having soles with an auxetic structure are described in Cross, U.S. patent application Ser. No. 14/030,002, filed Sep. 18, 2013 and entitled "Auxetic Structures and Footwear with Soles Having Auxetic Structures" (the "'002 application"), which is incorporated by reference above.

Figure 3:
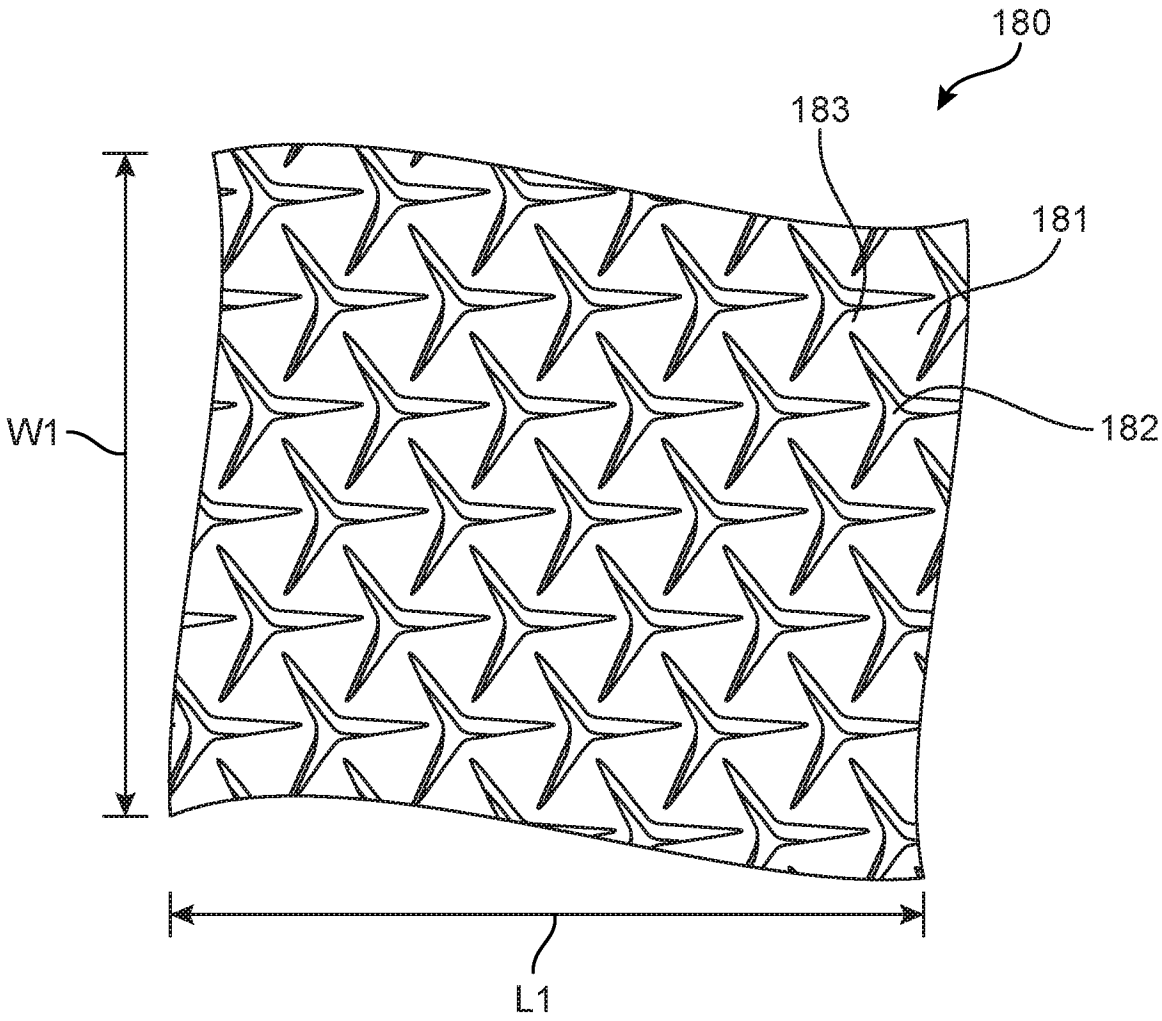
FIG. 3 is a schematic diagram of a portion of an auxetic material when it is not under tension, according to an embodiment.
Figure 4:
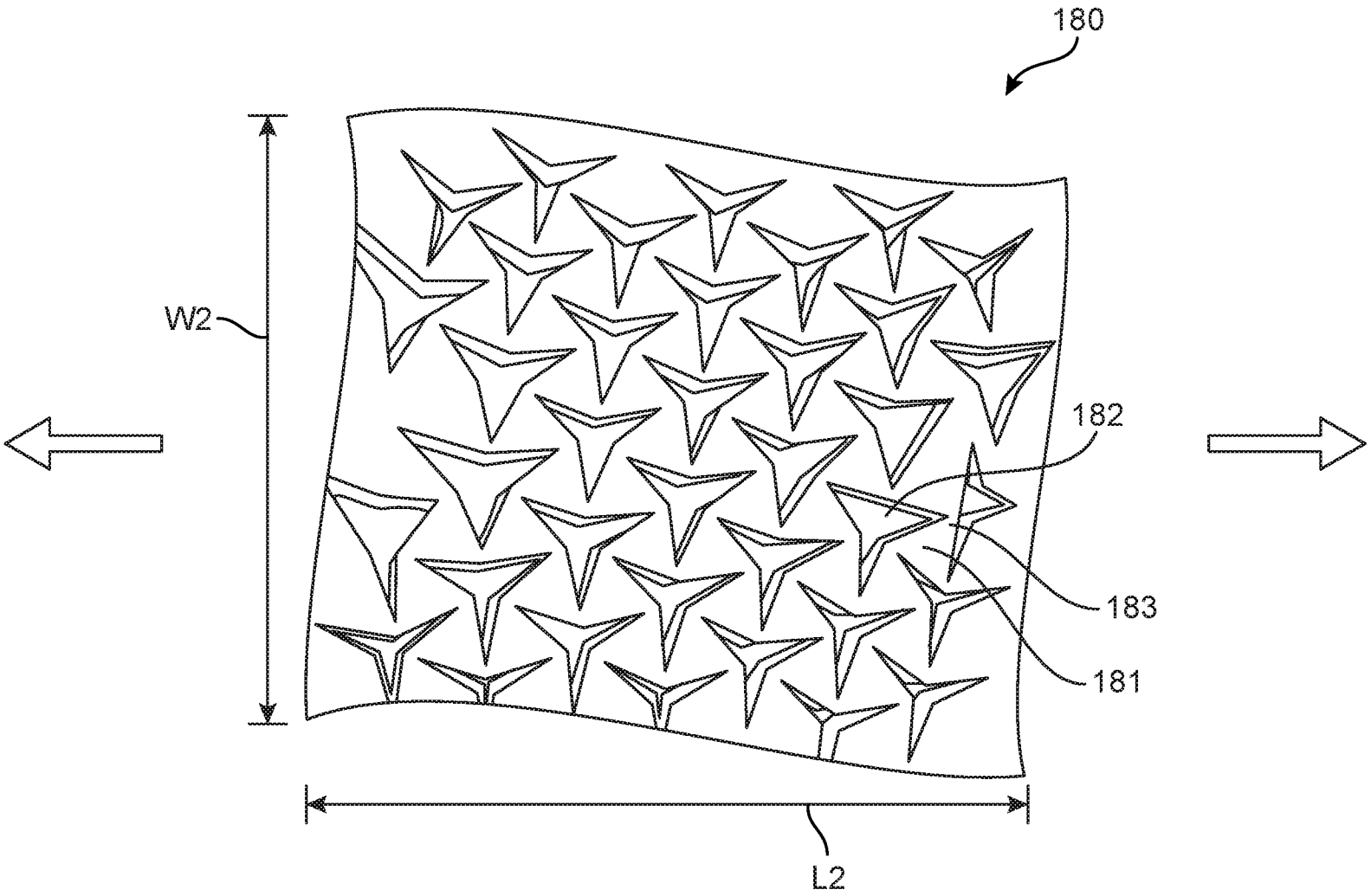
FIG. 4 is a schematic diagram of the auxetic material of FIG. 3 when it is under tension.

As described in the '002 application, auxetic materials have a negative Poisson's ratio, such that when they are under tension in a first direction, their dimensions increase both in the first direction and in a direction orthogonal the first direction. This property of an auxetic material is illustrated in FIG. 3 and FIG. 4. FIG. 3 is a schematic plan view of an example of a rectangular portion of an auxetic material when it is not under tension. In the example shown in FIG. 3, the portion of auxetic material 180 has triangular components 181 around star-shaped apertures 182. Triangular components 181 are joined at their vertices by connecting portions 183. When it is not under tension in any direction, the portion of auxetic material 180 has a length L1 and a width W1.

Although the embodiments depict bladder members with apertures having approximately polygonal geometries, including approximately point-like vertices at which adjoining sides or edges connect, in other embodiments some or all of an aperture could be non-polygonal. In particular, in some cases, the outer edges or sides of some or all of an aperture may not be joined at vertices, but may be continuously curved. Moreover, some embodiments can include apertures having a geometry that includes both straight edges connected via vertices as well as curved or non-linear edges without any points or vertices.

Similarly, the geometry of portions of a bladder member that define one or more apertures may vary in different embodiments. In the exemplary configuration, star shaped apertures 182 are shaped and arranged to define a plurality of approximately triangular portions, with boundaries defined by edges of adjacent apertures. Of course, in other embodiments polygonal portions could have any other shape, including rectangular, pentagonal, hexagonal, as well as possibly other kinds of regular and irregular polygonal shapes. Furthermore, it will be understood that in other embodiments, apertures may be arranged on an outsole to define geometric portions that are not necessarily polygonal (e.g., comprised of approximately straight edges joined at vertices). The shapes of geometric portions in other embodiments could vary and could include various rounded, curved, contoured, wavy, nonlinear as well as any other kinds of shapes or shape characteristics.

FIG. 4 is an illustration of the portion of auxetic material of FIG. 3 when it is under tension in the horizontal direction, as shown by the arrows in FIG. 4. Because portion of auxetic material 180 is under tension in the horizontal direction, the length of auxetic material 180 has increased to length L2, such that length L2 is greater than length L1. Because auxetic material 180 is an auxetic material with a negative Poisson's ratio, the width W2 of auxetic material 180 has also increased, such that width W2 is greater than width W1. Thus, it may be seen that applying tension to auxetic material 180 along a first direction has the effect of expanding auxetic material 180 in both the first direction and a second direction perpendicular to the first direction (e.g., the lengthwise and widthwise directions).

The auxetic structure of bladder member 200 allows sole structure 150 to have great flexibility in all directions and to take on complex shapes such as compound curves, for example.

In some embodiments, the auxetic structure of bladder member 200 comprises one or more fluid-filled chambers such as air bladders. As used herein, bladder members that have an auxetic structure may be referred to herein as an auxetic bladder. Articles of footwear incorporating fluid-filled chambers or air bladders are disclosed in U.S. Pat. No. 7,132,032, issued Nov. 7, 2006, entitled "Bladder with Multi-Stage Regionalized Cushioning"; application Ser. No. 13/723,116, filed Dec. 20, 2012 and entitled "Article of Footwear with a Harness and Fluid-Filled Chamber Arrangement"; U.S. application Ser. No. 13/336,429, filed Dec. 23, 2011 and entitled "Article of Footwear Having an Elevated Plate Sole Structure"; and U.S. application Ser. No. 13/717,389, filed Dec. 17, 2012 and entitled "Electronically Controlled Bladder Assembly"; all of which are incorporated by reference in their entirety in this application.

FIGS. 5-10 are schematic diagrams of an embodiment of bladder member 200 showing its auxetic structure in greater detail, and demonstrating its operation. Bladder member 200 may be formed of fluidly-connected inflated components. In the embodiment shown in FIG. 5, the auxetic structure of bladder member 200 is formed from inflated triangular components 210 around star-shaped apertures 220. Star-shaped apertures 220 have a plurality of vertices 221 that cooperatively define triangular components 210. Except for the triangular components at the perimeter of bladder member 200, the triangular components 210 are generally fluidly-connected to three adjoining triangular components 210 via a connecting portions 211. As best shown in the enlarged view in FIG. 5, the common vertices of, for example, specific triangular component 212 and specific triangular component 213 form a specific connecting portion 214.

Connecting portions 211 function as hinged connections, allowing triangular components 210 to rotate in the plane of the midsole with respect to each other, as described in U.S. patent application Ser. No. 14/030,002, referenced above. As the article of footwear progresses through the various stages of a stride compressing, twisting, bending and decompressing the sole structure, this rotation allows the auxetic structure of bladder member 200 to conform to complex shapes such as compound curves, to absorb and attenuate impact forces, and then to return to its uncompressed state.

Although the inflated components of the auxetic bladder are shown as triangular components, in general they could be comprised of any geometric element that results in an auxetic structure. For example, the inflated components may be triangular, rectangular, hexagonal, diamond-shaped or polygonal, curved, non-linear, irregular, or may have any other shape that results in an auxetic structure for the auxetic bladder. Thus, in general, a bladder member may be comprised of inflated components that surround and define corresponding apertures. The inflated components and their corresponding apertures are arranged such that an auxetic structure bladder member 200 has an auxetic structure.

Figure 5:
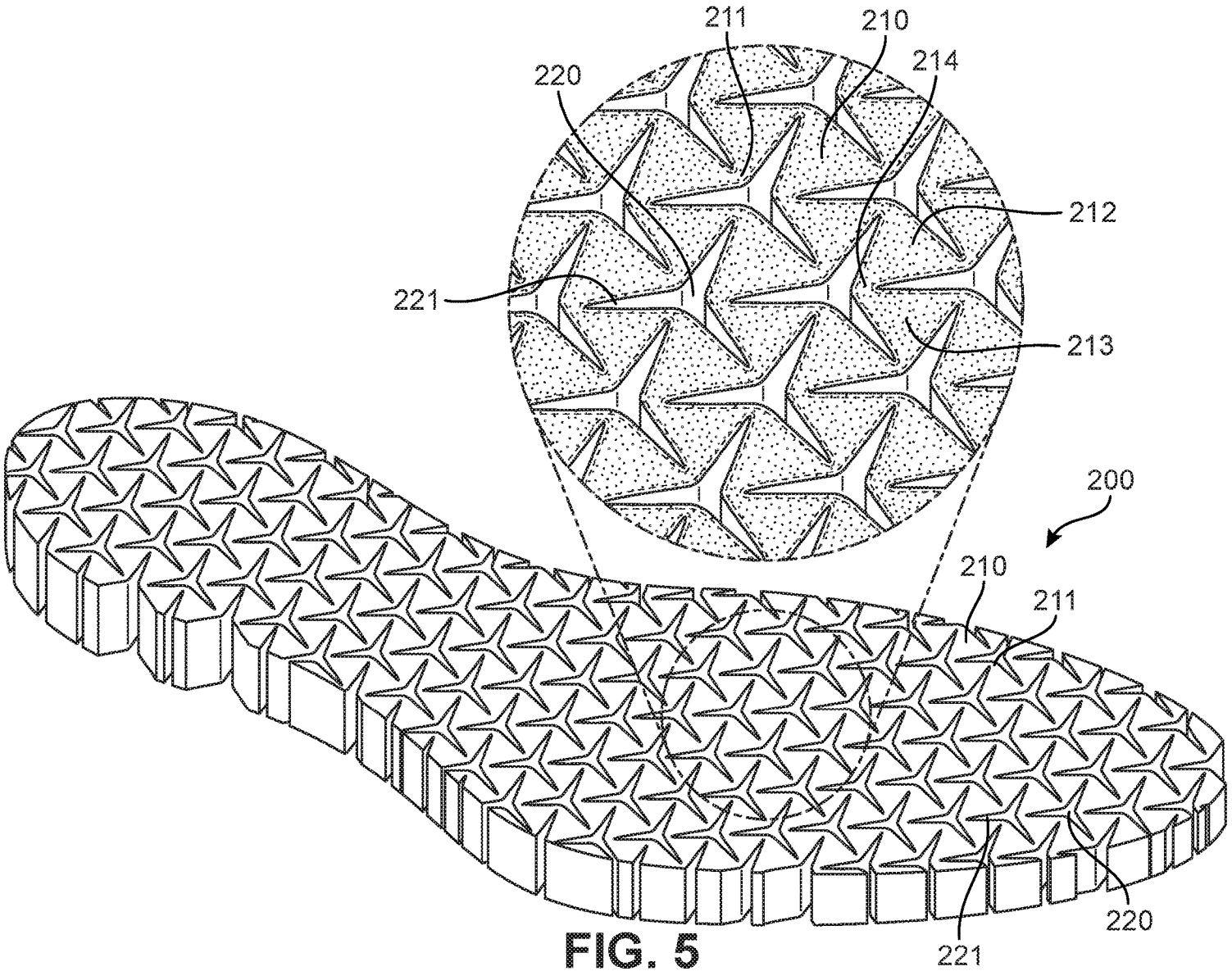
FIG. 5 is a schematic diagram of an embodiment of a midsole with an auxetic structure.

In different embodiments, the thickness of bladder member 200 could vary. The thickness of bladder member 200 may be substantially uniform, or it may taper down at certain peripheral regions, such as at the medial and lateral sides of the midsole, for example. In the embodiment of FIG. 5, bladder member 200 has a substantially uniform thickness.

Figure 6:
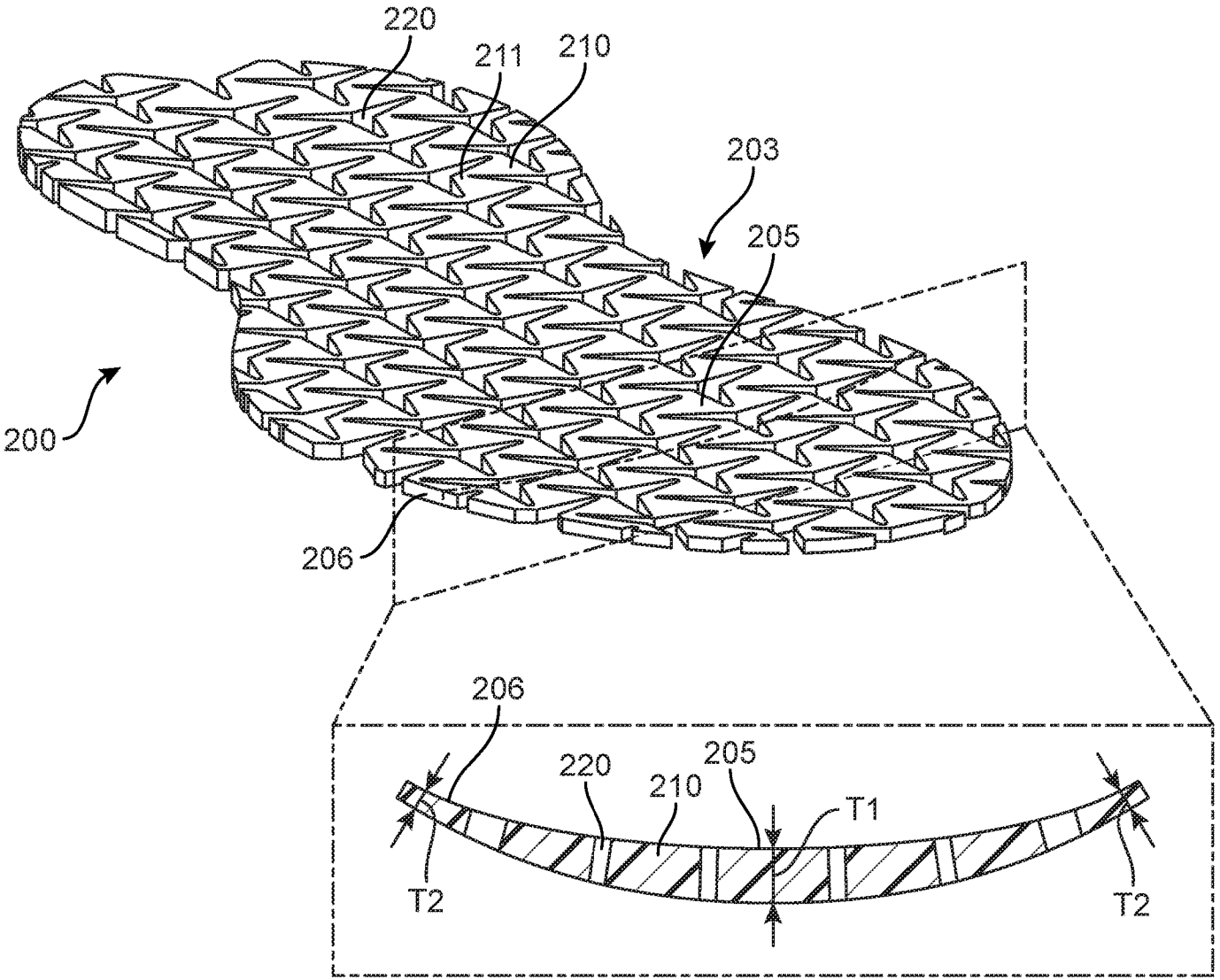
FIG. 6 is a schematic diagram of an embodiment of a bladder member with an auxetic structure showing a lateral cross-section of the forefoot of the bladder member.

For certain articles of footwear, the midsole structure may have a generally uniform thickness across its lateral extent. In other articles of footwear, the thickness of the midsole structure may vary, in order to specifically suit the particular athletic or recreational activity that the article of footwear is intended to be used for. For example, FIG. 6 illustrates an embodiment of bladder member 200 in which the midsole has a greater thickness in the central region 205 of forefoot portion 203 of bladder member 200 compared to the thickness of bladder member 200 at peripheral regions 206. As shown in the cross-section of FIG. 6, the thickness T1 in the central region 205 of bladder member 200 is substantially greater than the thickness T2 of bladder member 200 at peripheral region 206. This configuration may provide greater shock absorption over the greater part of the sole, while providing a responsive feel at the perimeter of the sole.

Figure 7:
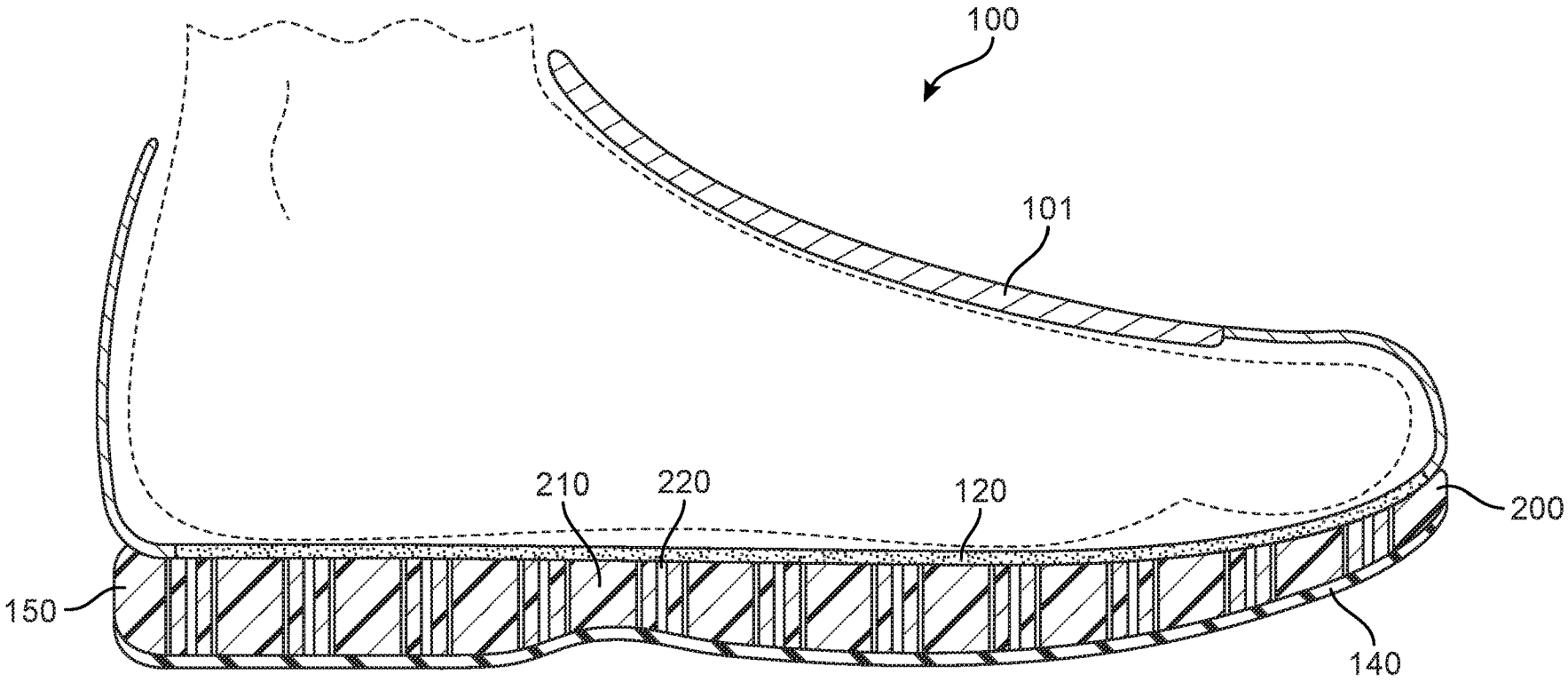
FIG. 7 is a schematic diagram of an embodiment of a longitudinal cross-section of an article of footwear with an auxetic bladder member.

FIG. 7 is a longitudinal cross-section of an article of footwear 100 with an auxetic bladder member 200. Sole structure 150, which includes an insole 120, a bladder member 200 and an outsole 140 is attached to upper 101 by conventional means such as, for example, stitching, stapling, adhesives, fusing and welding. FIG. 7 shows triangular components 210 and star-shaped apertures 220 of bladder member 200 in cross-section.

Figure 8:
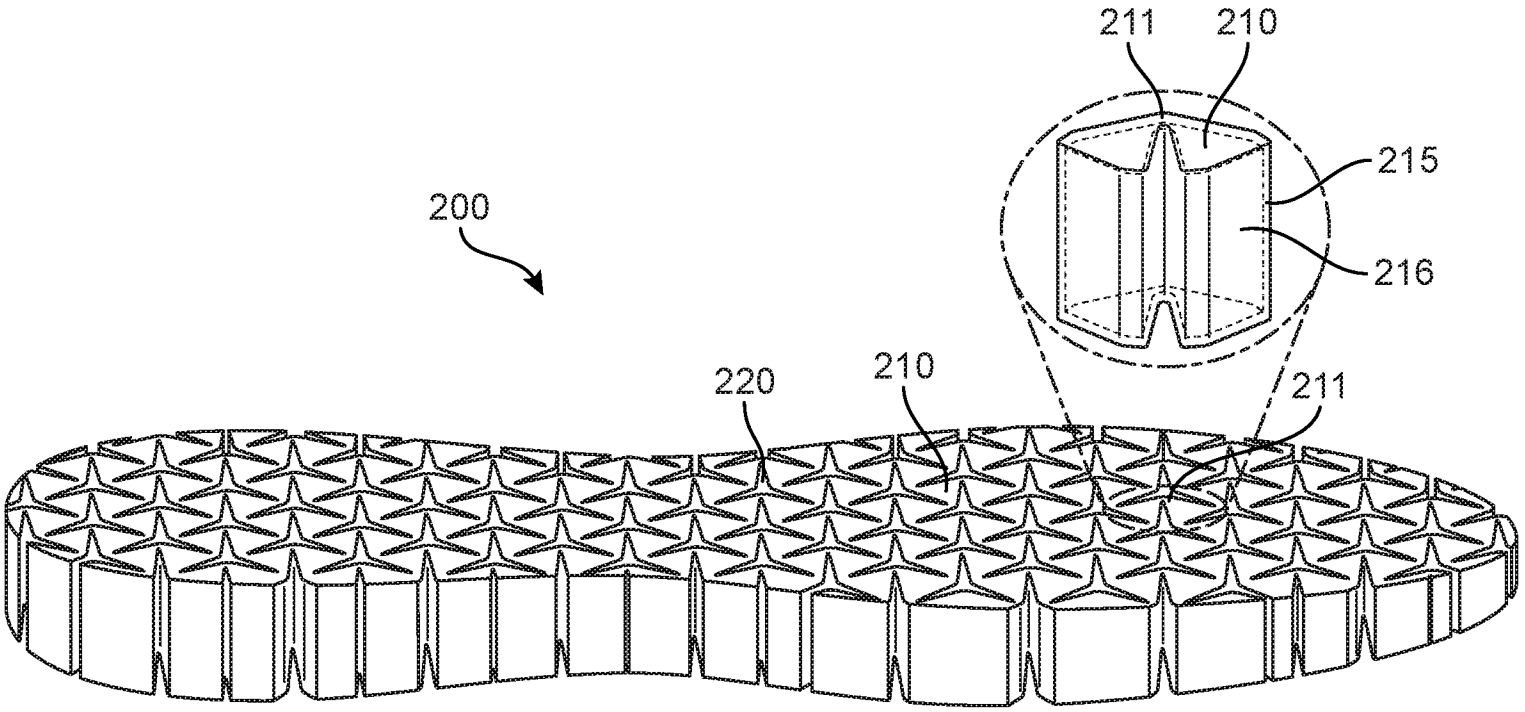
FIG. 8 is a side perspective view of an embodiment of an auxetic bladder member.
Figure 9:
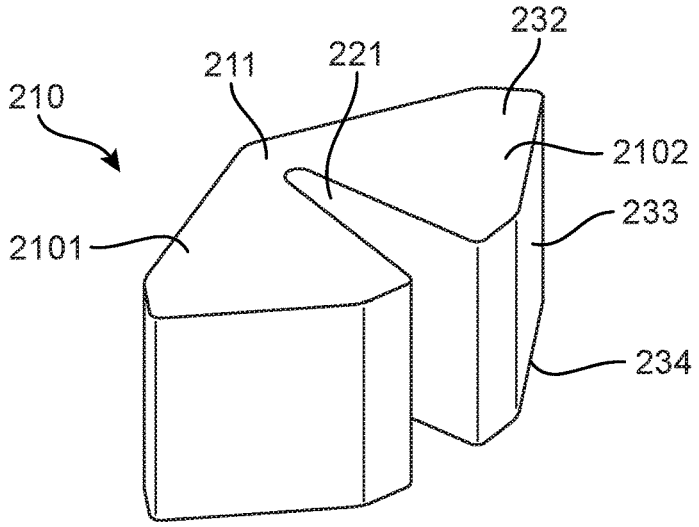
FIG. 9 is a schematic diagram of two adjoining triangular components joined at their common vertices.
Figure 10:
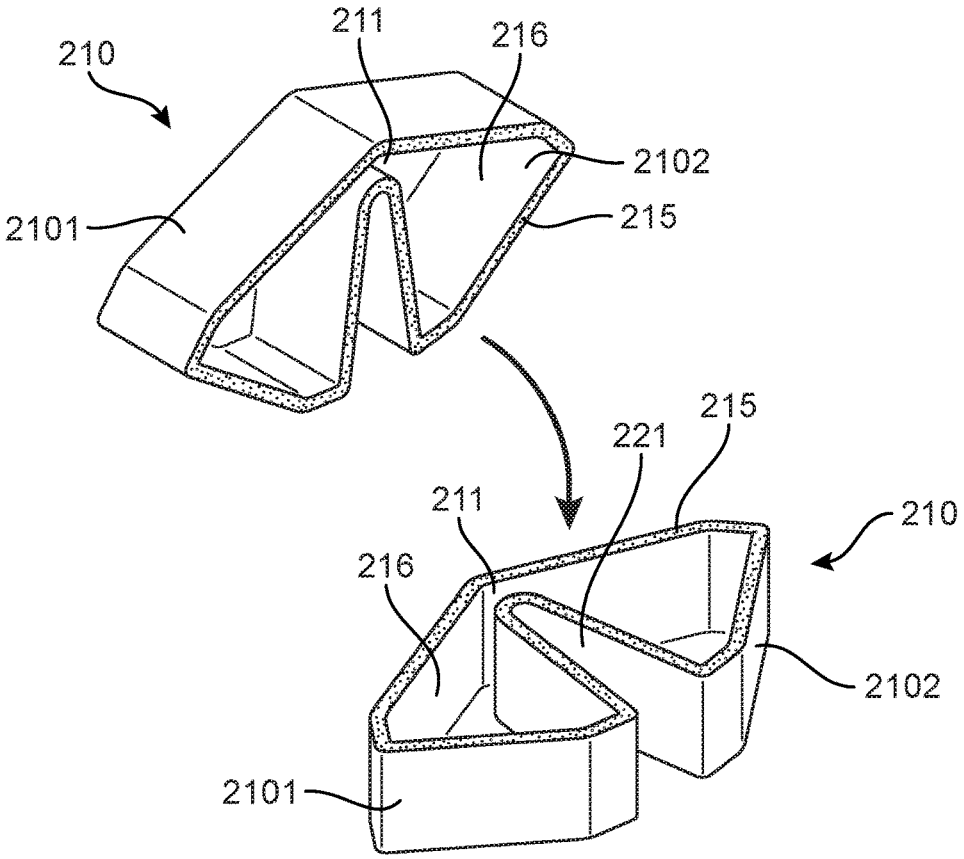
FIG. 10 is a cutaway illustration of the adjoining triangular components shown in FIG. 9.

FIGS. 8-10 illustrate the structure of adjoining triangular components 210 of auxetic bladder member 200. Each of triangular components 210 is hollow, with walls 215 defining inflatable chambers 216. As described above, connecting portions 211 are formed from the common vertices of the adjoining triangular components, such that triangular components 210 can rotate with respect to each other. In embodiments where adjacent triangular components 210 are in fluid communication, connecting portions 211 also provide the fluid connection between adjoining triangular components, as described in greater detail below.

FIG. 9 and FIG. 10 illustrate the construction of two adjoining triangular components in more detail.

These figures show two triangular components 210, triangular component 2101 and triangular component 2102 on either side of the vertex 221 of a star-shaped aperture 220 (shown in FIG. 5). Triangular component 2101 and triangular component 2102 are joined at their common vertices, which are associated with connecting portions 211. FIG. 9 is a schematic diagram of triangular component 2101 and its adjoining triangular component 2102 on either side of the vertex 221 of a star-shaped aperture. Triangular component 2101 and triangular component 2102 have a top surface 232 that forms part of the top surface of the auxetic bladder. The side surface 233 of the triangular components forms the side of one of the star-shaped aperture 220 identified in FIG. 5, for example. In at least some embodiments, triangular components 210 have a triangular prism geometry, with side surface 233 extending between the triangular top surface 232 and a corresponding triangular bottom surface 234.

Each of connecting portions 211 has an opening that allows fluid to flow from one triangular component to an adjoining triangular component. FIG. 9 shows that triangular component 2101 and triangular component 2102 are hingedly joined at their common vertices by a connecting portion 211 which also functions as a conduit allowing fluid to flow from one triangular component to an adjoining triangular component.

FIG. 10 is a cutaway illustration of the two adjoining triangular components, triangular component 2101 and triangular component 2102. This cutaway illustration shows that walls 215 of triangular component 2101 and triangular component 2102 form a chamber 216 that may be filled with a fluid or other material. Connecting portion 211 is hollow, thus allowing fluid flow between adjoining triangular components. It should be noted that, as a general rule, each of the triangular components in auxetic bladder member 200 may be fluidly connected to three adjoining triangular components, unless that particular triangular component is at or near a perimeter of the sole or otherwise is at or near an edge of an auxetic bladder. For purposes of illustration, each of the two triangular components of FIGS. 9 and 10 are shown as being connected to one other triangular component, with sealed walls at their remaining vertices.

Embodiments may be filled with a variety of different fluids or materials. Fluids used to fill triangular components of bladder member 200 include, but are not limited to: gases (e.g., air or nitrogen), liquids, gels, or possibly other fluids. It is also contemplated that some embodiments could utilize a flowable fine powder or other type of flowable particulate to fill one or more chambers of the triangular components.

Figure 11:
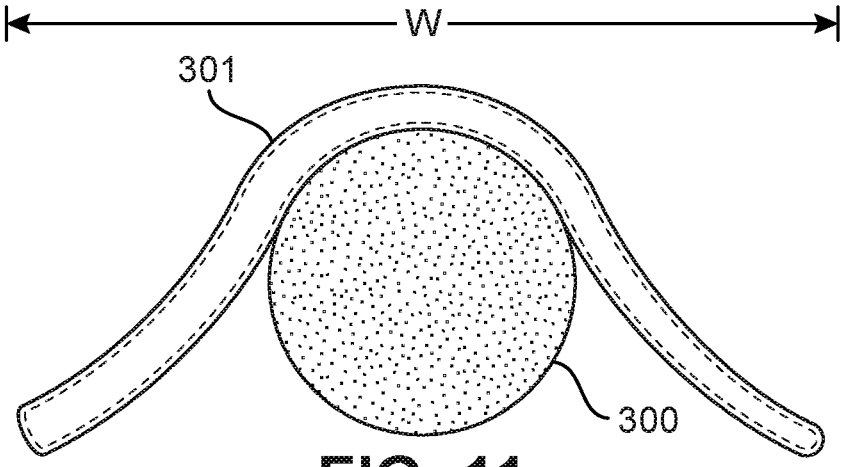
FIG. 11 Prior Art
FIG. 11 is an elevation view of a conventional midsole curving laterally around a spherical object, as seen from the front while bending in a lengthwise direction.
Figure 12:
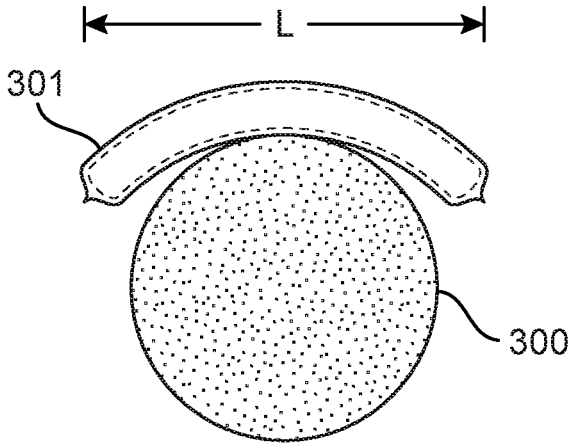
FIG. 12 is a perspective view of the conventional bladder member of FIG. 11, as seen from the side while bending along a widthwise direction.

FIGS. 11-15 may be used to illustrate the performance of a bladder 301 that does not have an auxetic structure to the performance of a bladder member 200 that has the auxetic structure described above. Here, midsole 301 may comprise materials such as foam and/or other midsole materials known in the art. FIG. 11 is an elevation view of a bladder 301 wrapped laterally in the direction of the width W of the footwear over a spherical object 300, as seen from the front. FIG. 12 is a side view of the midsole of FIG. 11. FIG. 12 shows that when a conventional midsole 301 is curved laterally over a spherical object (as shown in FIG. 11), it will not simultaneously also curve longitudinally in the direction of the length L of the footwear over a significant extent of the spherical object (as shown in FIG. 12). In other words, midsole 301 is unable to conform to a shape that requires, for example, curving both laterally (around a longitudinal axis) and longitudinally (around a lateral axis).

Figure 13:
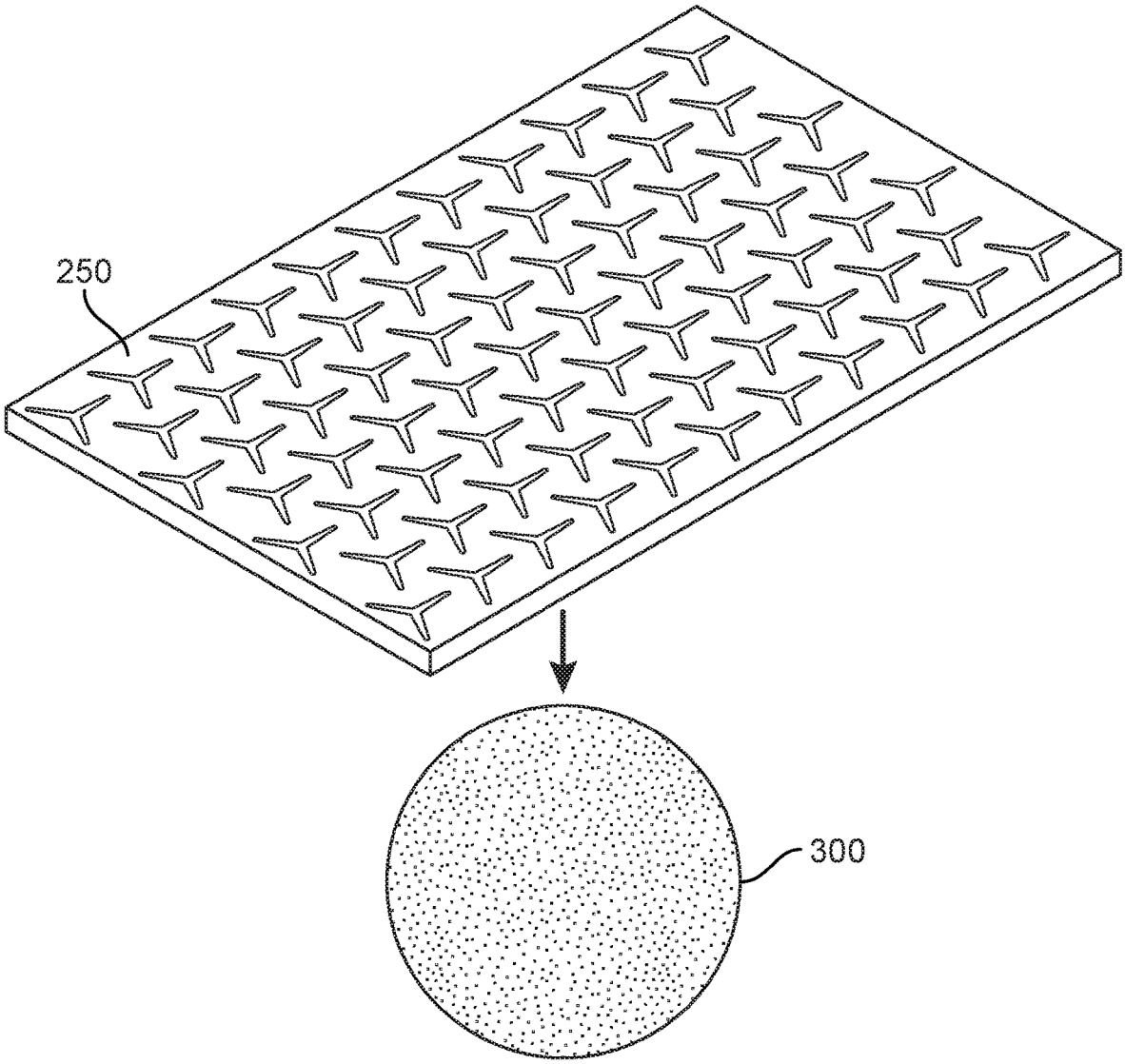
FIG. 13 is a schematic illustration of a portion of an auxetic bladder member about to be applied to a spherical object, according to an embodiment.
Figure 14:
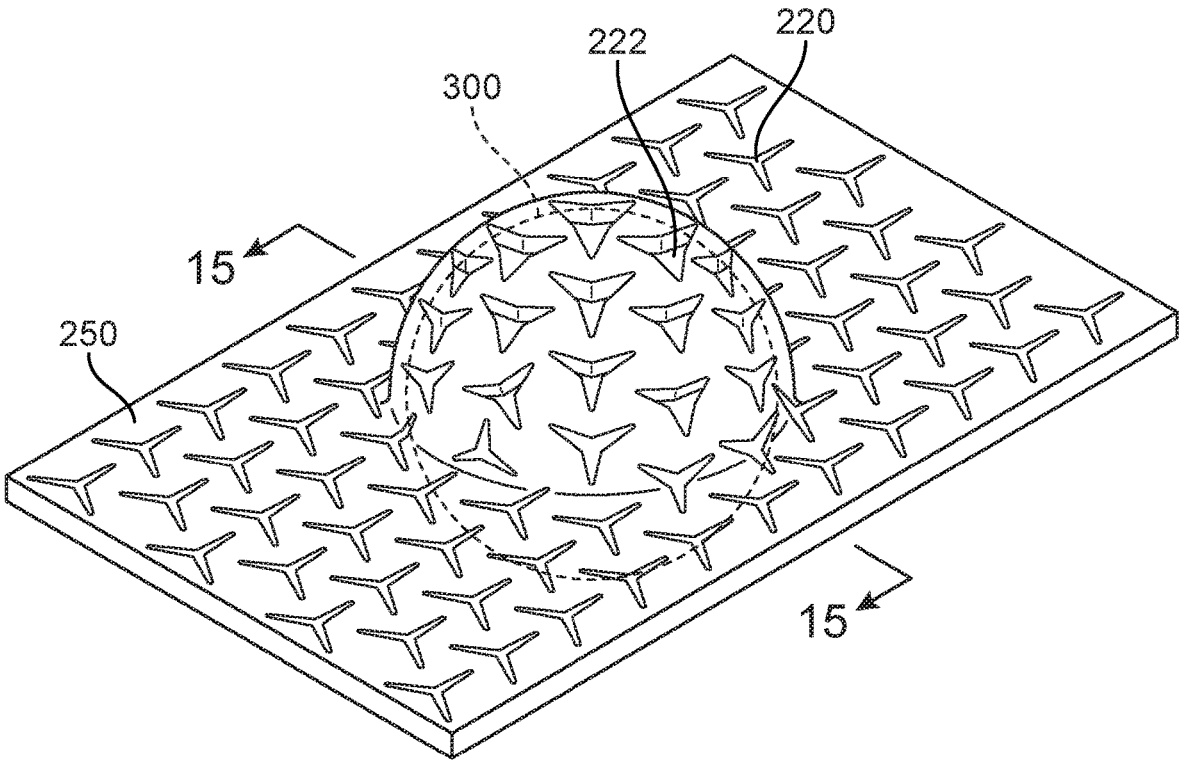
FIG. 14 is a view of the auxetic bladder member of FIG. 13, as applied over a spherical object.
Figure 15:
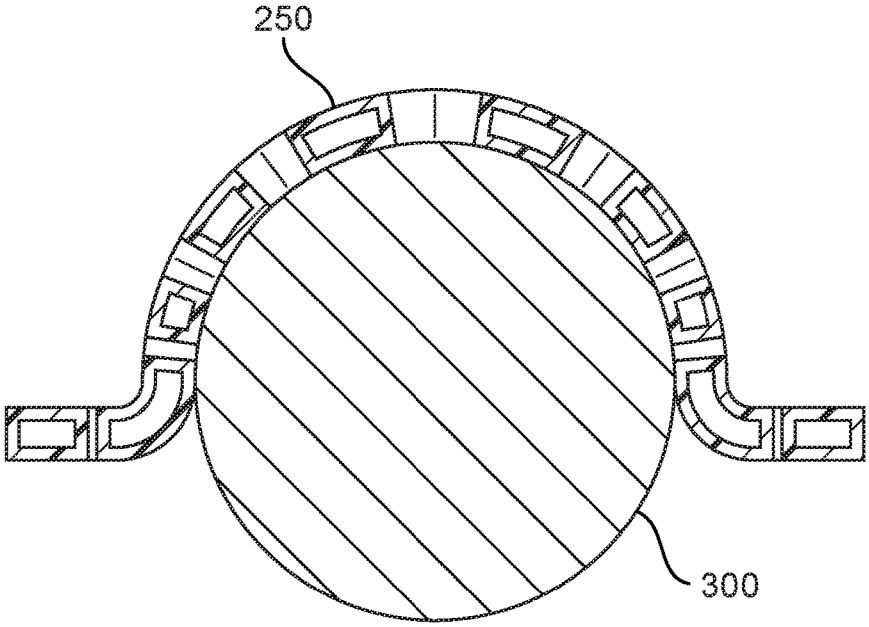
FIG. 15 is a cross-section of the auxetic bladder member of FIG. 14 taken as indicated by the arrows labeled 15-15 in FIG. 14.

On the other hand, FIGS. 13-15 show that the auxetic structure of bladder member 200 can conform to the shape of spherical object 300 by curving both laterally and longitudinally at the same time. FIG. 13 is an illustration of a portion 250 of an auxetic bladder member 200 as it is about to be applied to a spherical object 300. FIGS. 14 and 15 illustrate the performance of an auxetic bladder member 200 as it is applied over spherical object 300. As shown in FIG. 14, the star-shaped apertures 222 in the part of the portion 250 of bladder member 200 that curves over spherical object 300 are somewhat enlarged compared to the star-shaped apertures 220 in the flat parts of the portion 250 of bladder member 200. Because of this ability to adapt to the spherical surface of spherical object 300, bladder member 200 conforms more closely to the surface of spherical object 300, as shown most clearly in the cross-sectional view of FIG. 15. Thus FIG. 15 (showing a portion of bladder member 200) contrasted with FIG. 12 (showing midsole 301) illustrates the greater ability of an auxetic bladder member to conform to shapes with three-dimensional curvatures.

It will be understood that although the embodiments of FIGS. 13-15 depict simultaneous lateral and longitudinal bending or curving of bladder member 200, bladder member 200 may generally be configured to bend simultaneous in any two approximately perpendicular directions. Specifically, bladder member may bend both in a first direction and a second direction simultaneously, where the first direction and the second direction may generally be parallel with bladder member 200.

Figure 16:
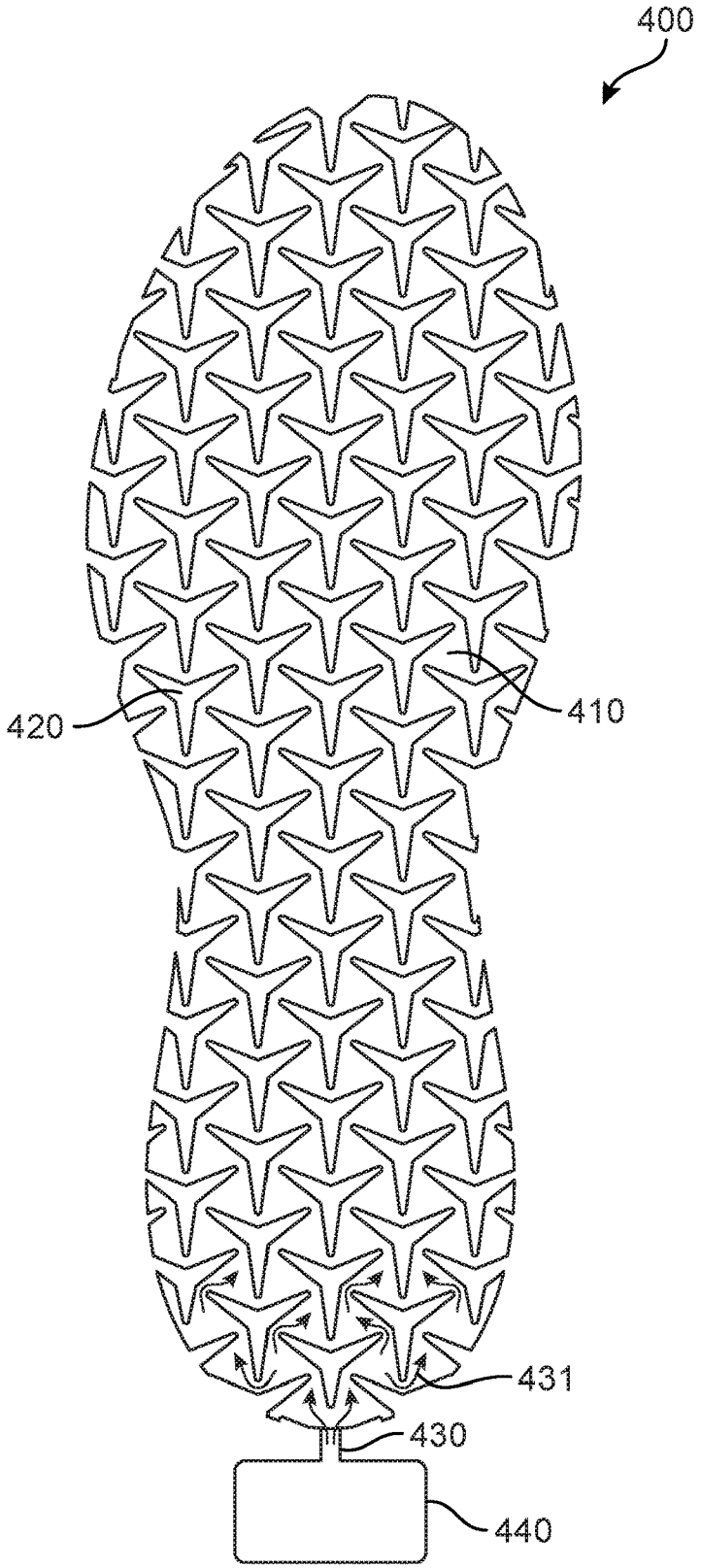
FIG. 16 is a schematic diagram of an embodiment of an auxetic bladder member as it is being inflated.
Figure 17:
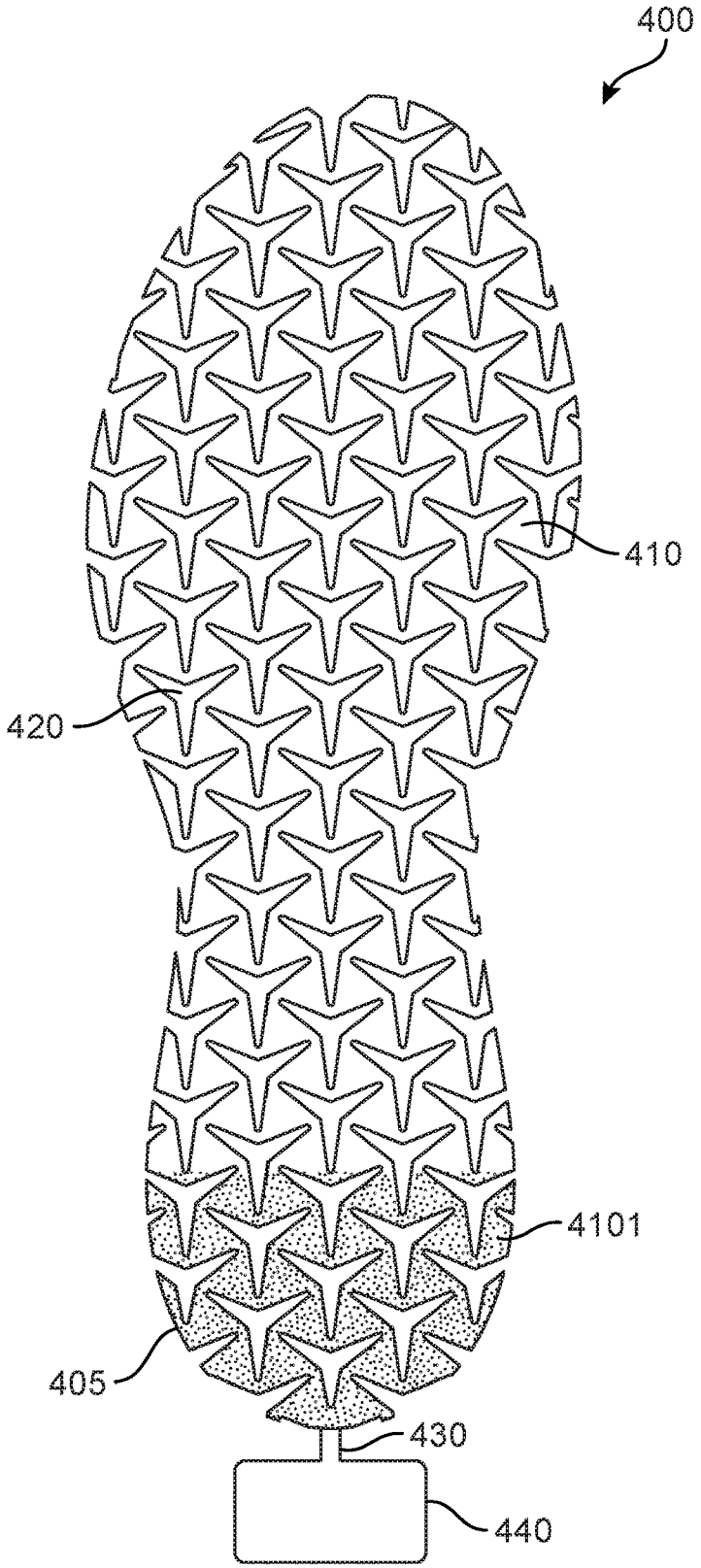
FIG. 17 is a schematic diagram of an embodiment of the auxetic bladder member of FIG. 16 illustrating the auxetic bladder member when the rear part of the heel portion of the bladder member has been inflated.

FIGS. 16-24 illustrate different ways in which embodiments may compartmentalize the bladder member. FIGS. 16-20 illustrate a bladder member 400 in which its triangular components 410 are all fluidly connected, such that they collectively form a single bladder. FIG. 16 shows bladder member 400 with its triangular components 410 and its star-shaped apertures 420 just as inflation is initiated. In FIG. 16, triangular components 410 have just started receiving a supply of air, nitrogen or other fluid from fluid source 440 via passageway 430. Arrows 431 indicate the fluid flow as triangular components 410 start to be inflated. FIG. 17 shows bladder member 400 when the rear part of its heel portion 405 has been inflated, as shown by the shading of triangular components 4101 in the rear part of heel portion 405.

Figure 18:
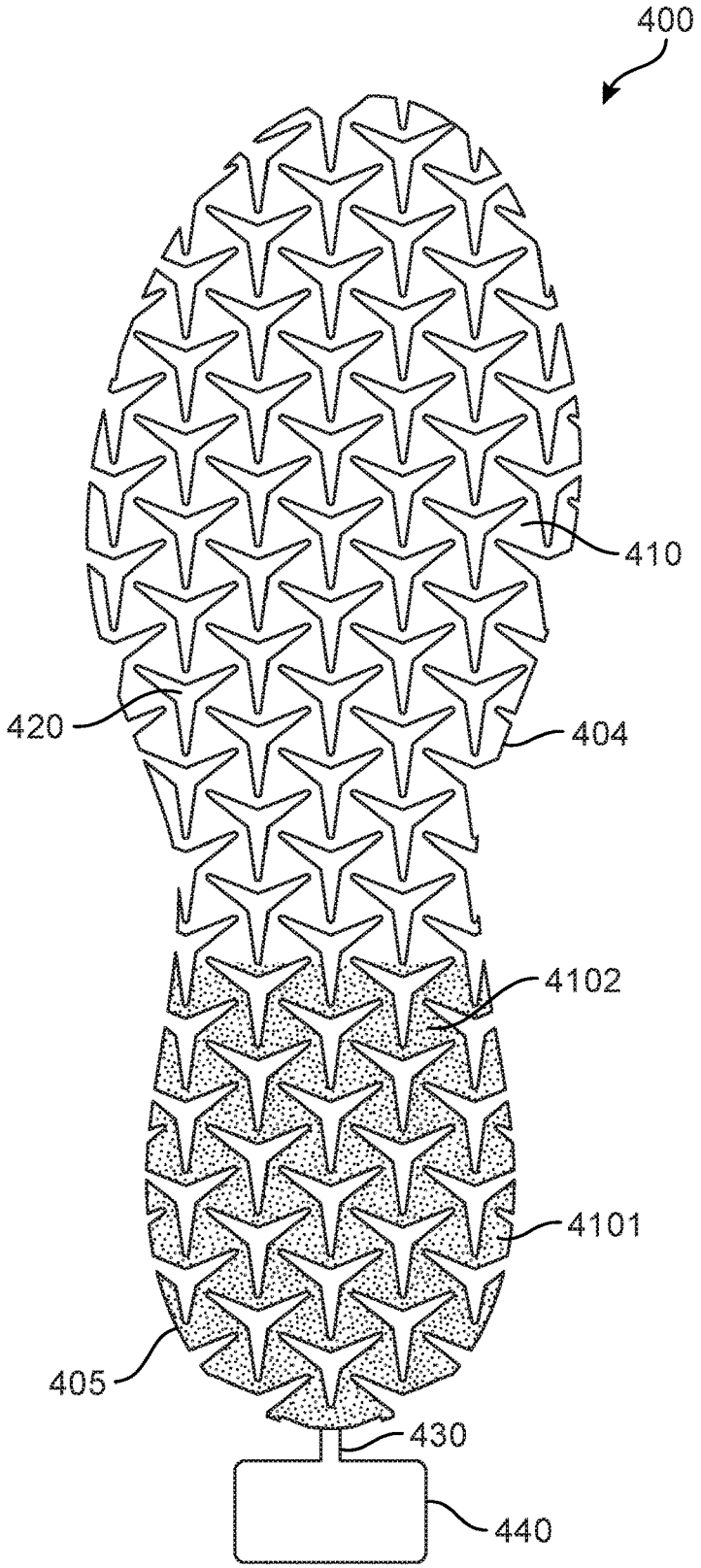
FIG. 18 is a schematic diagram of an embodiment of the auxetic bladder member of FIG. 16 illustrating the auxetic bladder member when the heel portion of the bladder member has been inflated.
Figure 19:
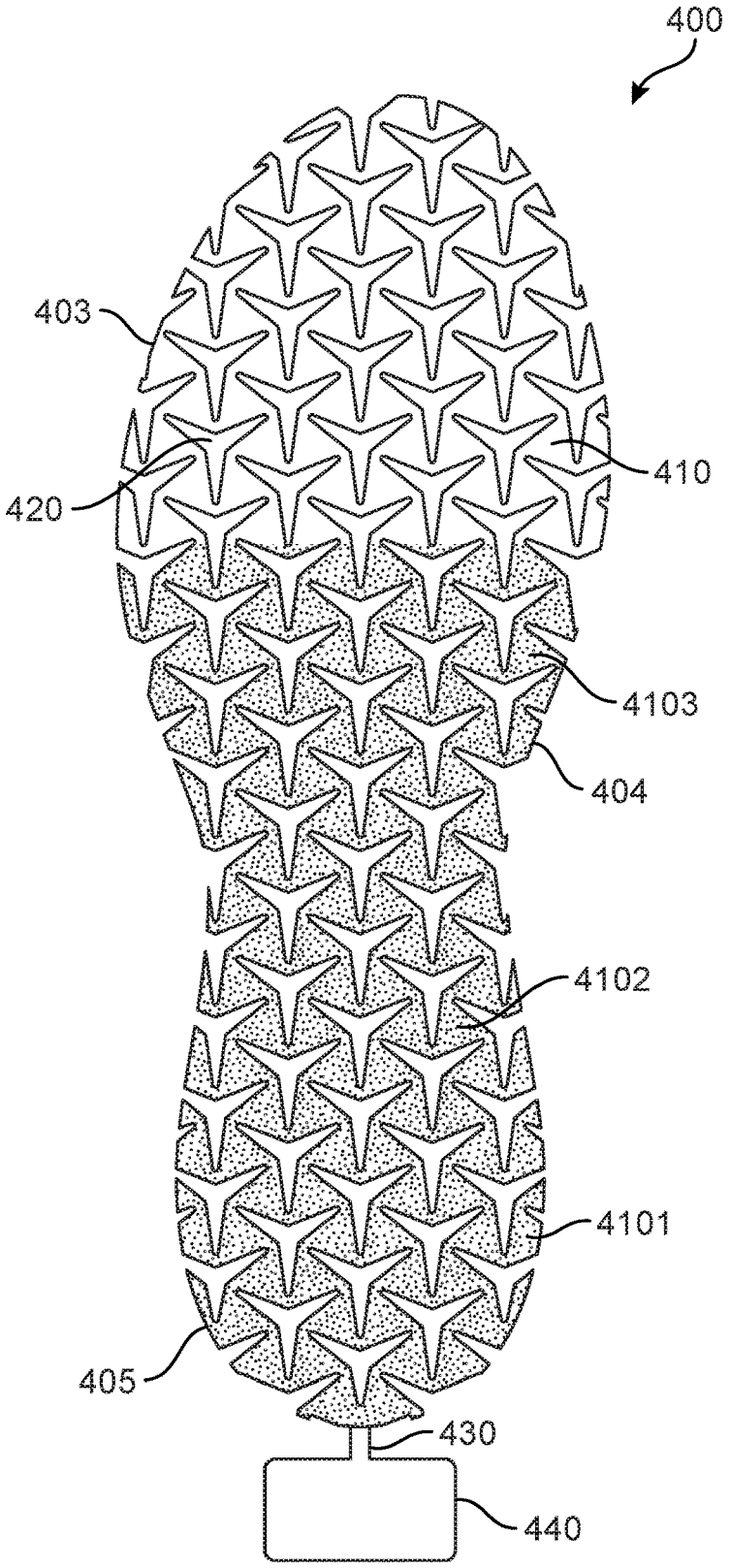
FIG. 19 is a schematic diagram of an embodiment of the auxetic bladder member of FIG. 16 illustrating the auxetic bladder member when the midfoot portion of the bladder member has been inflated.
Figure 20:
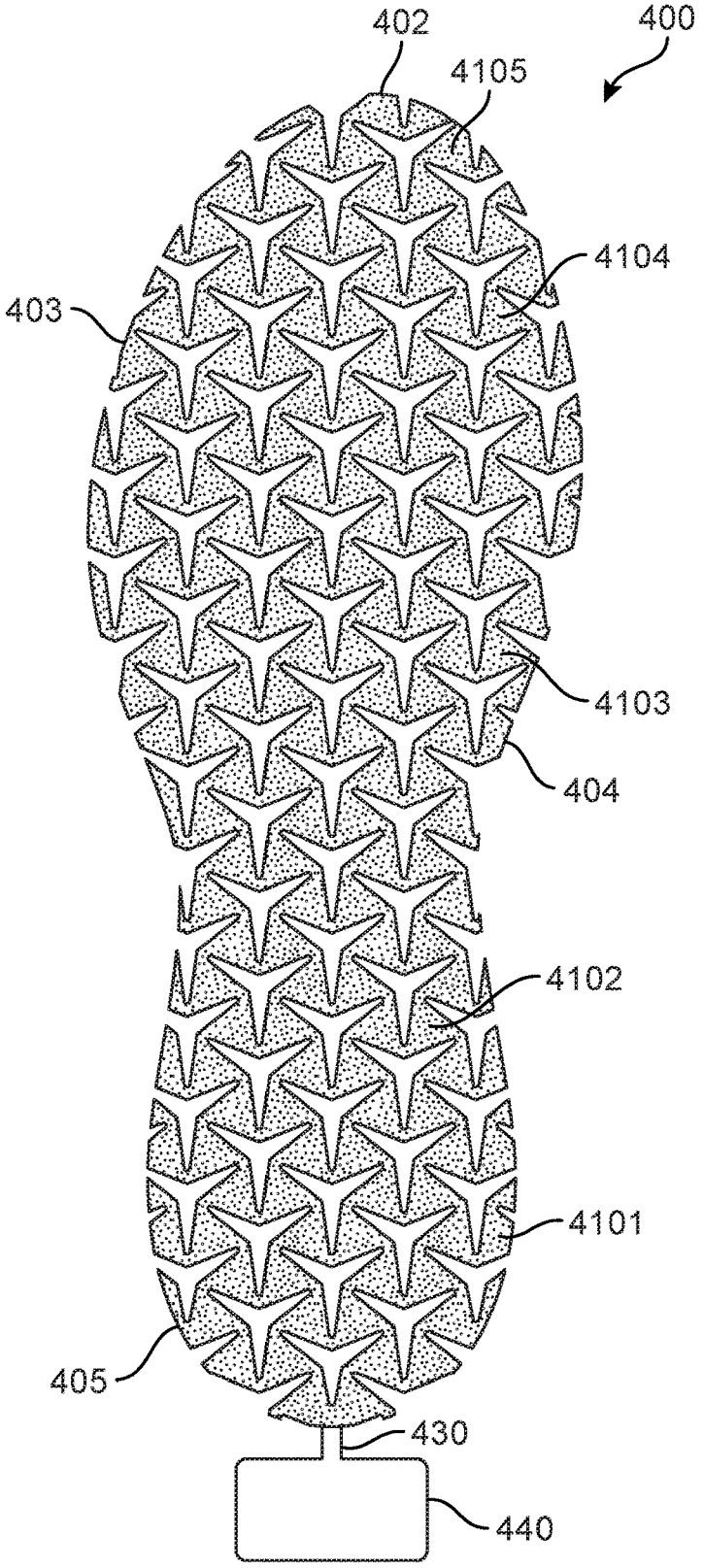
FIG. 20 is a schematic diagram of an embodiment of the auxetic bladder member of FIG. 16 illustrating the auxetic bladder member when the entire midsole has been inflated.

FIG. 18 shows bladder member 400 when the entire heel has been inflated, as shown by the shading of triangular components 4101 and triangular components 4102 in the heel portion 405 of bladder member 400. FIG. 19 shows bladder member 400 when the heel portion 405 and the midfoot portion 404 of bladder member 400 have been inflated, as shown by the shading of triangular components 4101, triangular components 4102 and triangular components 4103. FIG. 20 shows bladder member 400 when all of its triangular components have been inflated, including triangular components 4101 and triangular components 4102 in the heel portion 405 of bladder member 400, triangular components 4103 in the midfoot portion of bladder member 400, triangular components 4104 in the forefoot portion 403 of bladder member 400 and triangular components 4105 in the toe portion 402 of bladder member 400.

After all of the triangular components in bladder member 400 have been inflated, the entry port at passageway 430 may be sealed off, and bladder member 400 may be separated from fluid source 440. Alternatively, in some embodiments, a valve that may be opened or closed may be used instead of an entry port. In those embodiments, the inflation of triangular components 410 may be adjusted after fabrication of the article of footwear according to the preference of the individual wearer, or according to a particular athletic or recreational activity.

The embodiment shown schematically in FIGS. 17-20 has a single bladder composed of many triangular components 410, which are all inflated from one fluid source 440. This embodiment thus has all of the triangular components initially inflated to roughly the same pressure. For certain athletic and/or recreational activities, such as walking for example, having all the triangular components at roughly the same pressure provides the best combination of comfort and feel during the activity.

Figure 21:
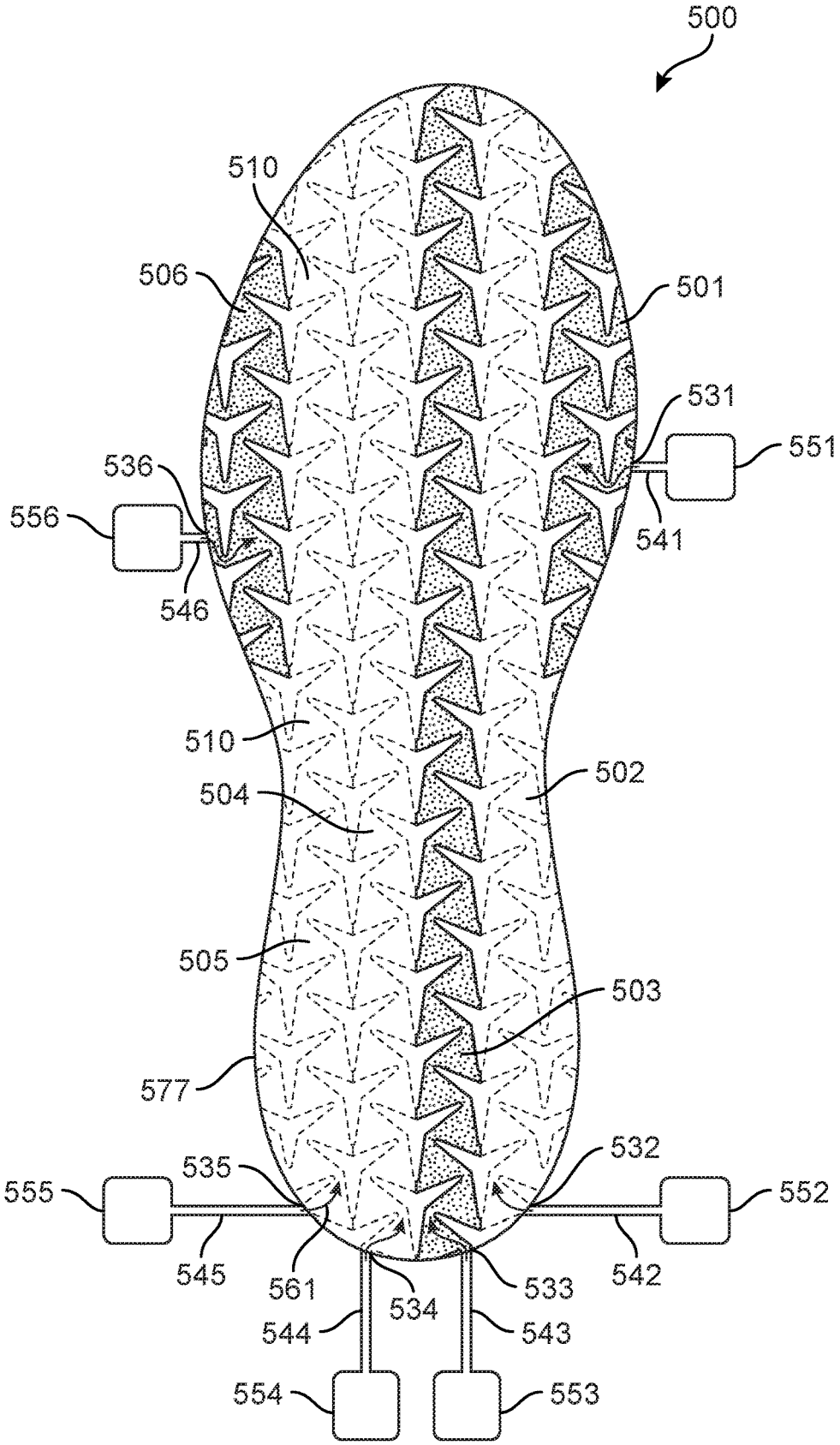
FIG. 21 is a schematic diagram of an embodiment of an auxetic midsole with separate longitudinal auxetic bladders.

However, other embodiments may have separate auxetic bladders forming all of the midsole or part of the midsole. Such a configuration might allow the pressures in different parts of the midsole to be tailored to a particular activity or to an individual's preference. For example, FIG. 21 is a schematic diagram illustrating an embodiment in which the auxetic midsole 500 has a series of separate generally longitudinal bladders certain of which extend from the heel region to the forefoot region of the midsole. In the example shown in FIG. 21, auxetic midsole 500 has six separate longitudinal bladders, including a longitudinal bladder 501, longitudinal bladder 502, longitudinal bladder 503, longitudinal bladder 504, longitudinal bladder 505 and longitudinal bladder 506, each comprised of triangular components 510 that are fluidly connected to each other and to a fluid supply via an entry port. In order to clarify the illustration, longitudinal bladder 501, longitudinal bladder 503 and longitudinal bladder 506 are shaded in FIG. 21, while longitudinal bladder 502, longitudinal bladder 504 and longitudinal bladder 505 are not shaded.

Thus the triangular components in longitudinal bladder 501 are fluidly connected via a passageway 541 and an entry port 531 to a medial side fluid (for example, air or nitrogen) supply 551; the triangular components in longitudinal bladder 502 are fluidly connected via a passageway 542 and an entry port 532 to a rear fluid (for example, air or nitrogen) supply 552; the triangular components in longitudinal bladder 503 are fluidly connected via a passageway 543 and an entry port 533 to a rear fluid (for example, air or nitrogen) supply 553; the triangular components in longitudinal bladder 504 are fluidly connected via a passageway 544 and an entry port 534 to a rear fluid (for example, air or nitrogen) supply 554; the triangular components in longitudinal bladder 505 are fluidly connected via passageway 545 and an entry port 535 to fluid (for example, air or nitrogen) supply 555; and the triangular components in longitudinal bladder 506 are fluidly connected via a passageway 546 and an entry port 536 to a lateral fluid (for example, air or nitrogen) supply 556.

Arrows 561 illustrate the flow of air, nitrogen or other fluid into the triangular components 510 that are inflated to form a separate auxetic bladder comprised of longitudinal bladder 501, a separate auxetic bladder comprised of longitudinal bladder 502, a separate auxetic bladder comprised of longitudinal bladder 503, a separate auxetic bladder comprised of longitudinal bladder 504, a separate auxetic bladder comprised of longitudinal bladder 505 and a separate auxetic bladder comprised of longitudinal bladder 506. Because each of these auxetic bladders is inflated from different separate supplies of air, nitrogen or other fluid, each of the bladders may be inflated to a specific pressure that may be best suited for that particular portion of the midsole, given the specific athletic or recreational activity the article of footwear may be intended for. For example, longitudinal bladder 501 on the medial side of the forefoot and longitudinal bladder 506 on the lateral side of the forefoot may be inflated to a different higher or lower pressure compared to the pressure in longitudinal bladder 503 and longitudinal bladder 504 that extend longitudinally along the central part of the midsole.

For example, the pressure in longitudinal bladder 501 and the pressure in longitudinal bladder 506 may be higher than the pressure in longitudinal bladder 503 or the pressure in longitudinal bladder 504. Such a selection of pressure may provide a higher stability at the medial and lateral sides of the forefoot, while also proving greater flexibility and comfort at the central part of the midsole. Also, even though FIG. 21 illustrates an example of an embodiment in which the auxetic bladders are inflated via entry ports that are sealed off after inflation, other examples may inflate one or more or all of the auxetic bladders via valves, so that the pressure within the auxetic bladders may be adjusted after fabrication of the midsole, for example to tailor the midsole characteristics to a specific person or activity.

Figure 22:
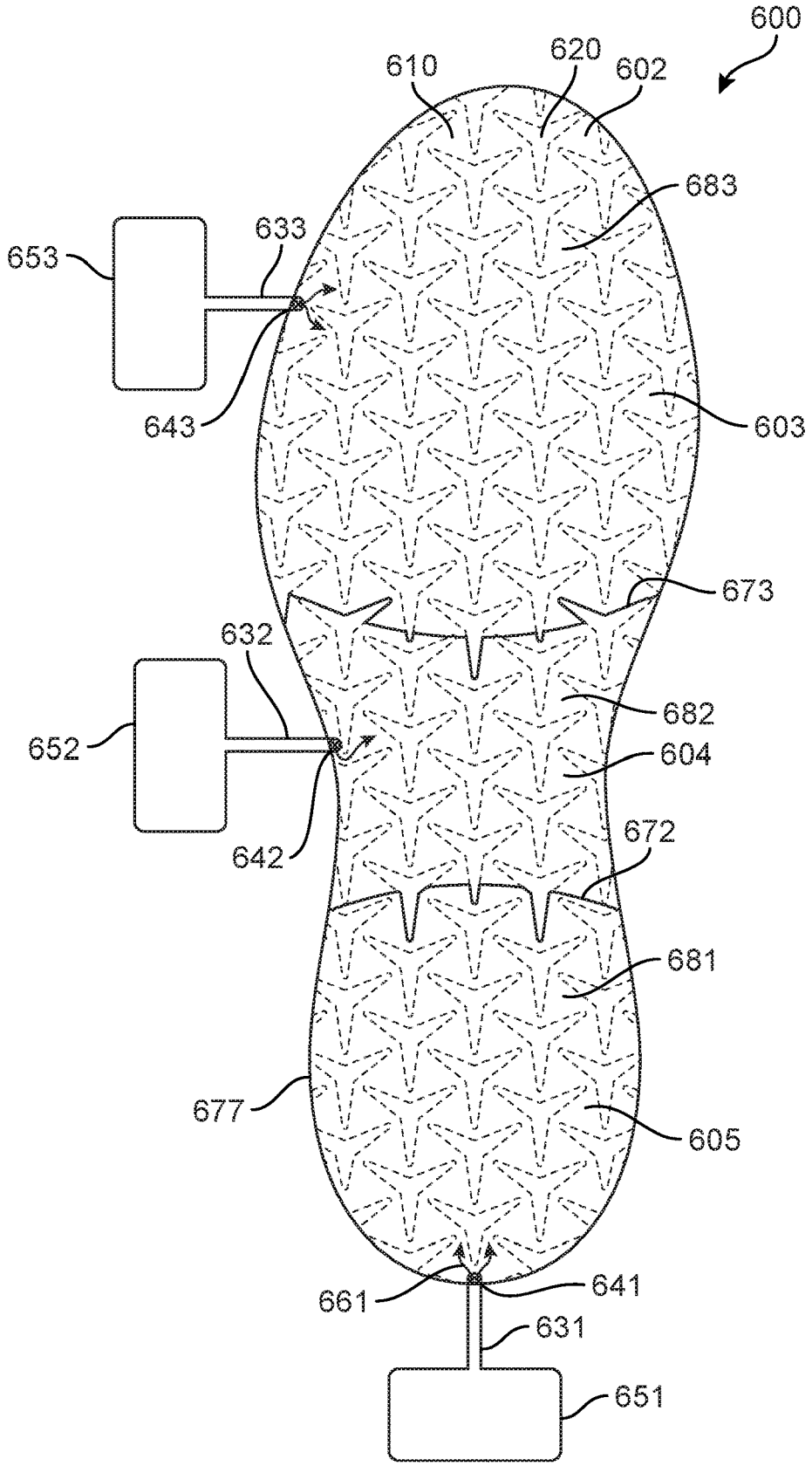
FIG. 22 is a schematic diagram of an embodiment of a midsole with separate auxetic bladders in different regions of the midsole.

FIG. 22 is a schematic diagram of an embodiment of an auxetic midsole 600 in which separate fluid-filled bladders are used in different regions of the midsole. Specifically, heel region bladder 681 is used in the heel region 605 of the midsole, midfoot region bladder 682 is used in the midfoot region 604 of the midsole 600, and forefoot/toe region bladder 683 is used in the forefoot region 603 and toe region 602 of the midsole, as shown in FIG. 22. Barrier 672 separates the heel region bladder 681 in the heel region 605 from the midfoot region bladder 682 in the midfoot region 604. Barrier 673 separates the forefoot/toe region bladder 683 in the forefoot region 603 and the toe region 602 from the midfoot region bladder 682 in the midfoot region 604.

In FIG. 22, arrows 661 indicate fluid flow into the auxetic air bladders. Thus the triangular components 610 in the forefoot region 603 and the toe region 602 are inflated from fluid (for example, air or nitrogen) supply 653 via passageway 633 and valve 643 as shown by arrows 661; the triangular components 610 in the midfoot region 604 are inflated from fluid (for example, air or nitrogen) supply 652 via passageway 632 and valve 642 as shown by arrows 661; and the triangular components 610 in the heel region 605 are inflated by fluid (for example, air or nitrogen) supply 651 via passageway 631 and valve 641, as shown by arrows 661.

Although the example shown in FIG. 22 uses valves to inflate the auxetic bladders, so that the pressure in the airbladders may be adjusted after fabrication of the midsole, in other examples the bladders could be inflated via entry ports that are sealed off after fabrication of the midsole.

Figure 23:
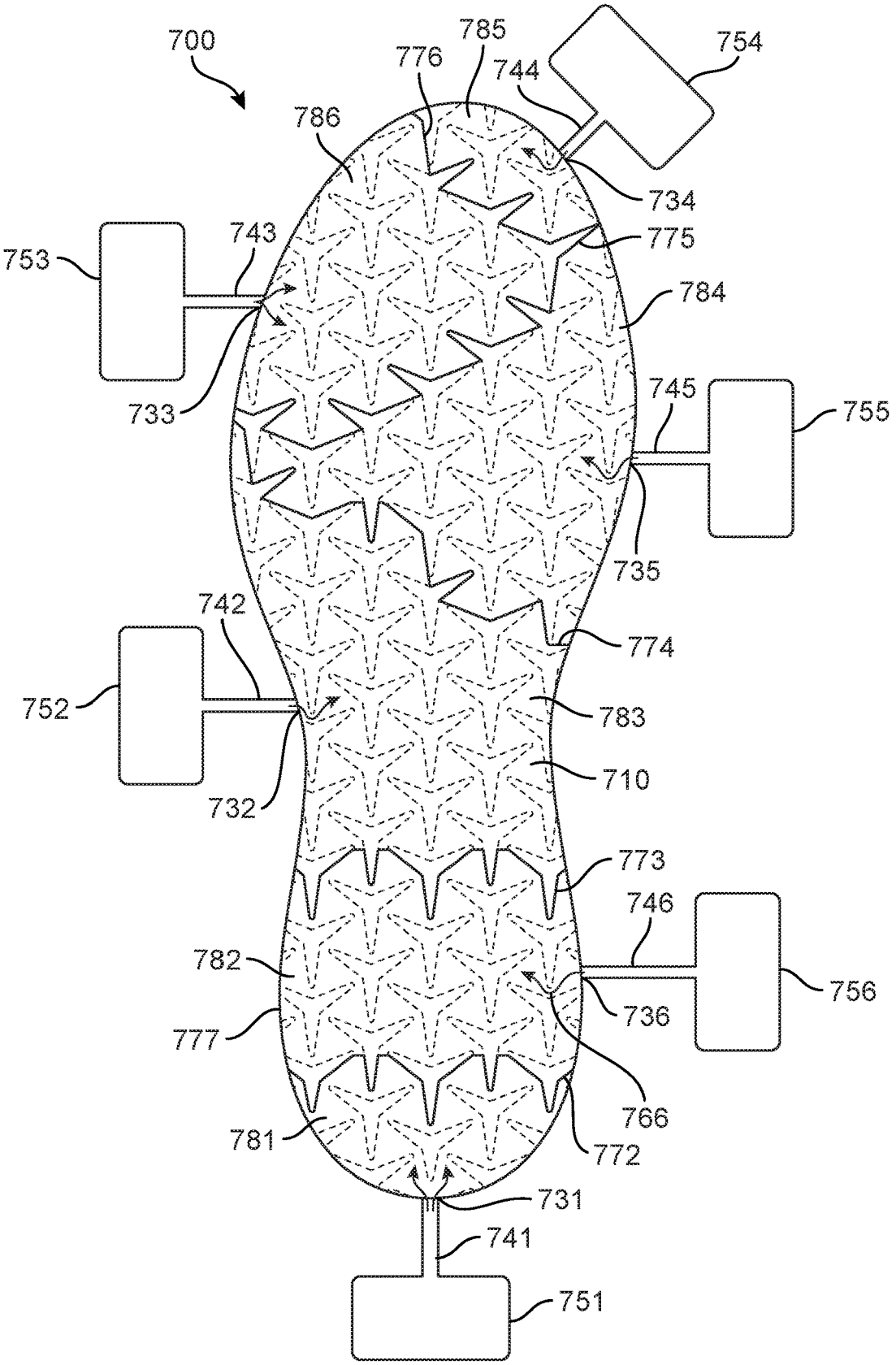
FIG. 23 is a schematic diagram of an embodiment of a midsole with separate auxetic bladders in different portions of the midsole.

Certain portions of the midsole may also have separate fluid-filled bladders. For example, FIG. 23 is a schematic diagram of an auxetic midsole 700 which has six separate fluid-filled (for example, air or nitrogen) bladders in different portions of the auxetic midsole 700. As shown in FIG. 23, barrier 772 separates bladder 781 in the back portion of the heel from bladder 782 in the front portion of the heel in midsole 700; barrier 773 separates bladder 782 from bladder 783 in the midfoot region of midsole 700; barrier 774 separates bladder 783 from bladder 784 on the medial side of the forefoot region of auxetic midsole 700; barrier 775 separates bladder 784 from bladder 786 on the lateral side of auxetic midsole 700; and barrier 776 separates bladder 786 from toe region bladder 785 in the toe region of auxetic midsole 700.

Each of the bladders may be filled from its own fluid (for example, air or nitrogen) supply via a passageway and an entry port. Thus bladder 781 is filled from fluid supply 751 via a passageway 741 and an entry port 731 as shown by arrows 766; bladder 782 is filled from fluid supply 756 via a passageway 746 and an entry port 736 as shown by arrow 766; bladder 783 is filled from fluid supply 752 via a passageway 742 and an entry port 732 as shown by arrow 766; bladder 784 is filled from fluid supply 755 via a passageway 745 and an entry port 735 as shown by arrow 766; bladder 782 is filled from fluid supply 756 via a passageway 746 and an entry port 736 as shown by arrow 766; bladder 785 is filled from fluid supply 754 via a passageway 744 and an entry port 734 as shown by arrow 766; and bladder 786 is filled from fluid supply 753 via a passageway 743 and an entry port 733 as shown by arrows 766.

Figure 24:
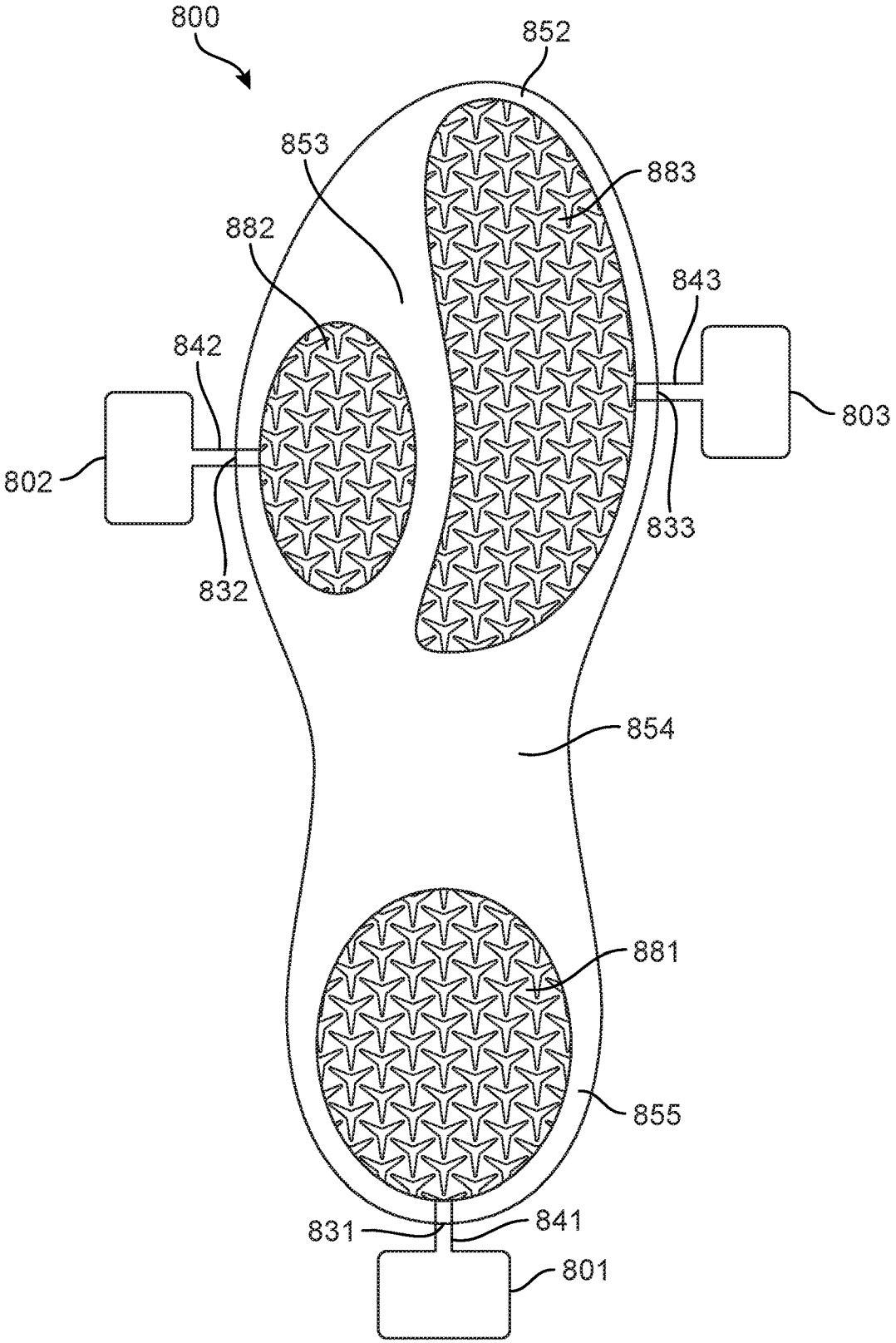
FIG. 24 is a schematic diagram of an embodiment of a midsole with separated auxetic bladders in specific portions of the midsole.

In some embodiments, auxetic bladders may also be used in only certain specific portions of the midsole, as illustrated in the example shown in FIG. 24. In this example, separate auxetic bladder 881 in the heel region 855, separate auxetic bladder 882 on the lateral side of the forefoot region 853, and separate auxetic bladder 883 on the medial side of the forefoot region 853 and the toe region 852 only cover particular portions of midsole 800. Midfoot region 854 does not have an auxetic bladder. The portions of midsole 800 that do not have an auxetic bladder may be fabricated from a conventional resilient polymer midsole material, such as ethylvinylacetate (EVA) or polyurethane (PU) or another polymer foam material or from another known material used for the manufacture of m idsoles.

As shown in FIG. 24, fluid (for example, air or nitrogen) supply 801 inflates bladder 881 in heel region 855 of midsole 800 via passageway 841 and entry port 831; fluid (for example, air or nitrogen) supply 802 inflates bladder 882 on the lateral side of forefoot region 853 of midsole 800 via passageway 842 and entry port 832; and fluid (for example, air or nitrogen) supply 803 inflates bladder 883 on the medial side of forefoot region 853 and toe region 852 of midsole 800 via passageway 843 and entry port 833. Auxetic bladder 881, auxetic bladder 882 and auxetic bladder 883 are separated from each other by the resilient polymer foam portions of midsole 800, which are made of a material such as EVA or PU.

The auxetic bladders disclosed herein may be formed from a variety of materials, such as thermoplastic polyurethane, polyurethane, EVA, polyester, polyester polyurethane, polyether polyurethane or other elastomeric materials. The air, nitrogen or other fluid within the auxetic bladders may be pressurized to pressures between about 1.0 atmosphere to about 3.5 atmospheres, inclusive. In addition to air and nitrogen, the fluid used in the bladders may be octafluorapropane, hexafluoroethane or sulfur hexafluoride or any of the gases disclosed in U.S. Pat. No. 4,340,626, which is hereby incorporated by reference herein, or other nonreactive gases.

The sole structures disclosed herein may be incorporated in articles of footwear that may be used in many types of athletic or recreational activities such as running, walking, training, tennis, racquetball, soccer, football, baseball, volleyball, basketball, cycling and hiking. These sole structures may also be incorporated in other types of footwear, such as loafers, slippers, sandals, dress shoes and work boots.

Figure 25:
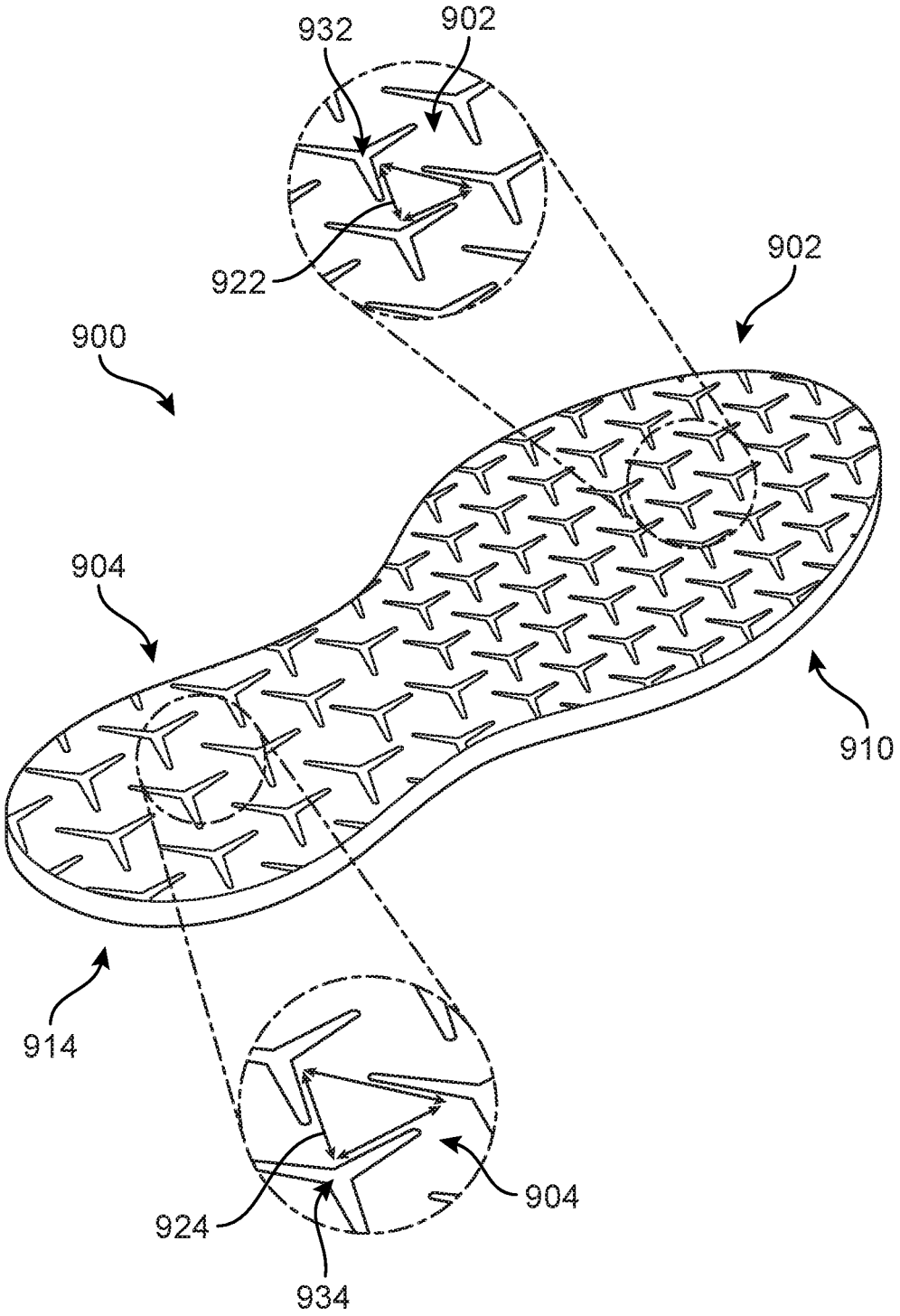
FIG. 25 is a schematic view of an embodiment of an auxetic bladder with regions of different sized apertures.

Some embodiments could incorporate apertures and/or inflated components of varying sizes. As one example, FIG. 25 illustrates a schematic view of a bladder member 900 that incorporates inflated components of at least two different sizes. Specifically, bladder member 900 includes first group of inflatable components 902 at forefoot portion 910 and second group of inflatable components 904 at heel portion 914. In the embodiment, inflatable components in the first group of inflatable components 902 are smaller than inflatable components in the second group of inflatable components 904. In particular, first group of inflatable components 902 are associated with a cross-sectional geometry having a first edge length 922, while second group of inflatable components 904 are associated with a cross-sectional geometry having a second edge length 924. In this case, first edge length 922 is substantially smaller than second edge length 924. In other words, first group of inflatable components 902 may be substantially smaller than second group of inflatable components 904. It will be appreciated that the sizes of corresponding apertures associated with each group of inflatable components may likewise change. For example, in the exemplary embodiment of FIG. 25, first group of apertures 932 associated with first group of inflatable components 902 are generally smaller than second group of apertures 934 associated with second group of inflatable components 904.

In still other embodiments, any configuration of inflatable components and/or apertures having any other relative sizes could be used. The relative and/or absolute sizes of inflatable components could be selected according to various factors including desired cushioning properties, desired expansion properties, part geometry, manufacturing constraints as well as possibly other factors. As one example, smaller geometries for inflatable components and/or apertures may increase the ability of a bladder member to contour to more highly curved surfaces. Thus, an exemplary configuration having smaller inflatable components/apertures in one portion than in another may allow some portions of a bladder member (e.g., a forefoot portion) to more dynamically adjust in geometry to surface features than other portions (e.g., a heel portion).

Figure 26:
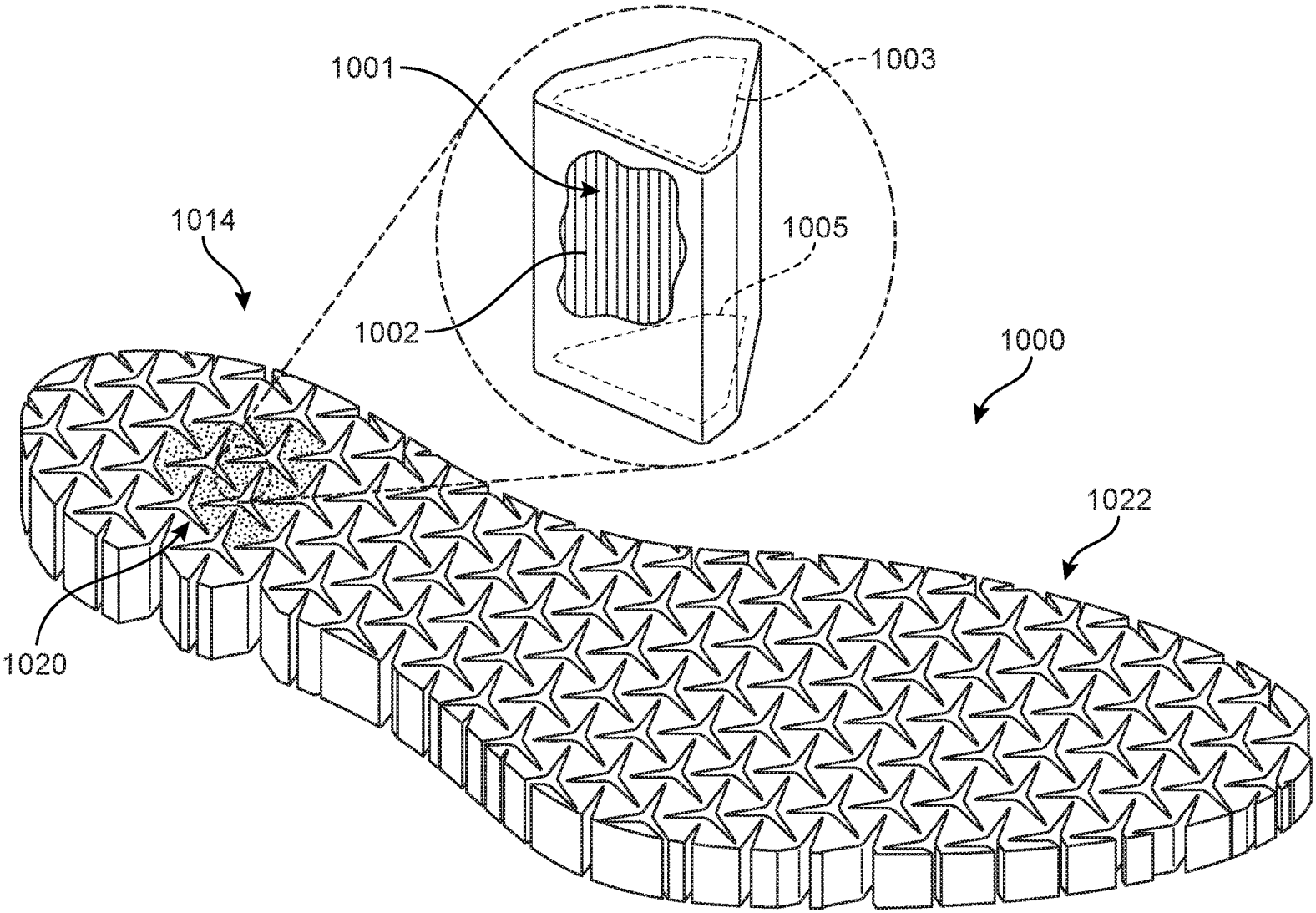
FIG. 26 is a schematic view of an embodiment of an auxetic bladder incorporating tensile elements.
Figure 27:
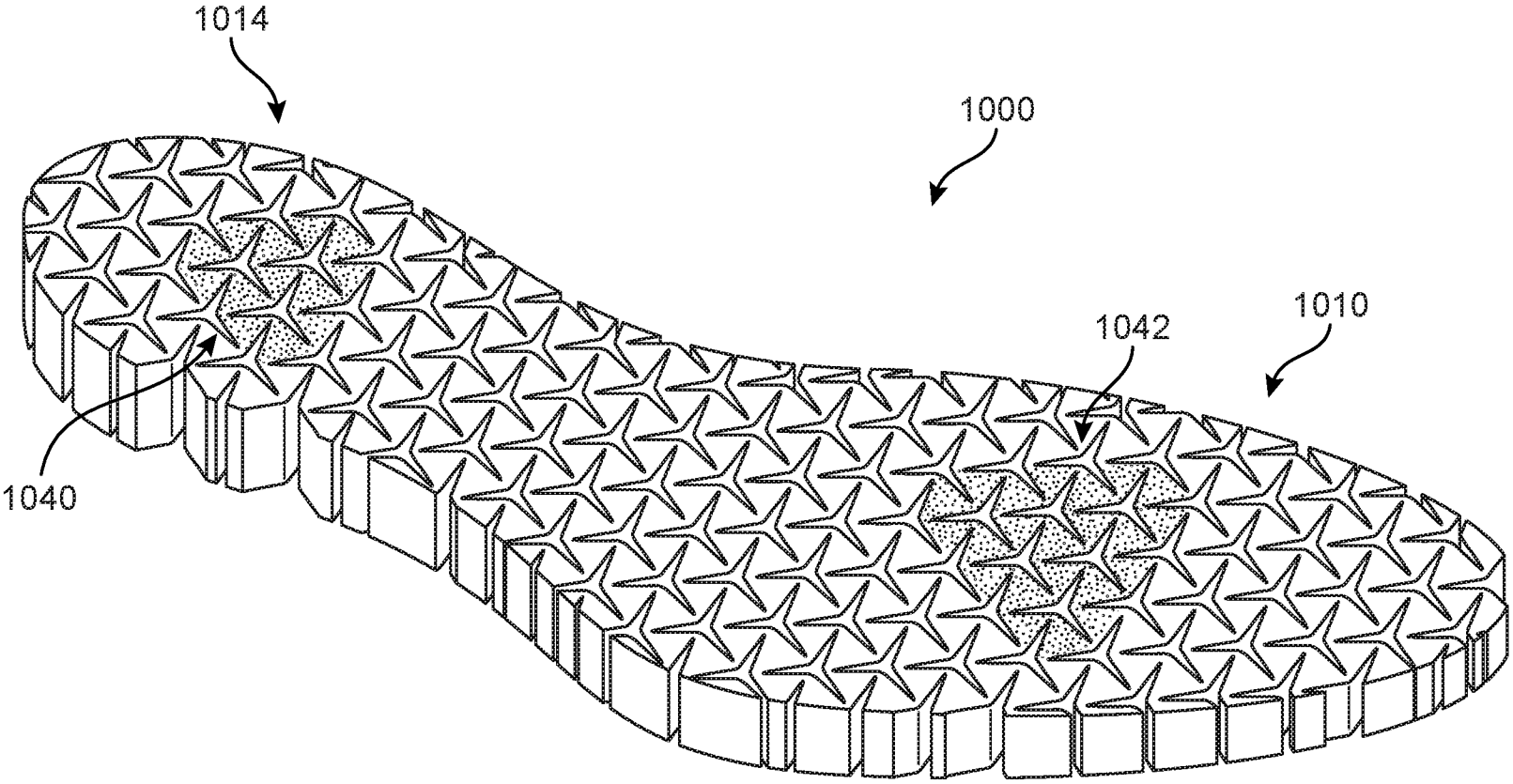
FIG. 27 is a schematic view of another embodiment of an auxetic bladder incorporating tensile elements.

FIGS. 26-27 illustrate another embodiment of a bladder member 1000. Referring to FIGS. 26-27, some embodiments can include provisions for controlling the tensile and/or compressive forces across different portions of a bladder member. Some embodiments may include, for example, various tensile members 1001 that can be distributed in various configurations within one or more inflatable components 1004. In some embodiments, tensile members (e.g., tensile member 1001) can comprise various layers and connecting members. In the exemplary embodiment, tensile member 1001 includes an upper tensile layer 1003, a lower tensile layer 1005 and a plurality of connecting members 1002 that join upper tensile layer 1003 and lower tensile layer 1005. Connecting members 1002 could comprise yarns, fibers or filaments formed of a variety of materials and may be positioned across a length and a width of tensile member 1001 at a relatively sparse density, a relatively packed density, or any other density. Tensile layer 1003 and tensile layer 1005 could be made of a variety of different polymer materials. Tensile layers (e.g., tensile layer 1003 and tensile layer 1005) could be bonded to in the interior surfaces of bladder member 1000 in some embodiments.

The tensile member configuration illustrated in FIG. 26 is only intended to be exemplary and it will be understood that a wide variety of different configurations of tensile members (including tensile layers and connecting members) are possible in other embodiments. Embodiments could utilize any of the tensile member configurations, materials and/or assembly methods that are disclosed in Hazenberg et al., U.S. Patent Publication Number 2012/0233878, published Sep. 20, 2012 and filed as U.S. patent application Ser. No. 13/049,256 on Mar. 16, 2011, and titled "Fluid-Filled Chamber with a Tensile Member," the entirety of which is herein incorporated by reference.

As shown in FIG. 26, some embodiments could incorporate tensile members in only inflatable components in a heel. In this case, a group of inflatable elements 1020 disposed in heel portion 1014 of bladder member 1000 include tensile members (indicated with shading in FIG. 26). In contrast, group of inflatable elements 1022 comprising forefoot portion 1010 of bladder member 1000 lack any tensile members and are instead filled only with fluid (liquid and/or gas). In an alternative configuration, shown in FIG. 27, a group of inflatable components 1040 disposed in heel portion 1014 of bladder member 1000 may include tensile members and a group of inflatable components 1042 disposed in forefoot portion 1010 of bladder member 1000 may also include tensile members (the location of components with tensile members are indicated with shading in FIG. 27). This alternative configuration may provide additional cushioning control in both the forefoot and heel portions of bladder member 1000. Of course, in still other embodiments, each inflatable component of a bladder member could incorporate tensile members.

The configuration of tensile members (including materials, geometry and location within a bladder member) may vary in different embodiments. In some embodiments, the location of tensile members may be selected to provide selective regions of increased strength and/or support. Moreover, providing tensile members in some portions but not all portions of a bladder member may provide for differential cushioning effects across the bladder member.

Bladder members having an auxetic configuration could be used with different kinds of articles and/or objects. In particular, the provisions discussed above for auxetic bladders and shown in the figures are not intended to be limited to use in articles of footwear. These bladder members could alternatively be incorporated into a wide variety of different kinds of articles of apparel, sporting equipment, etc.

Figure 28:
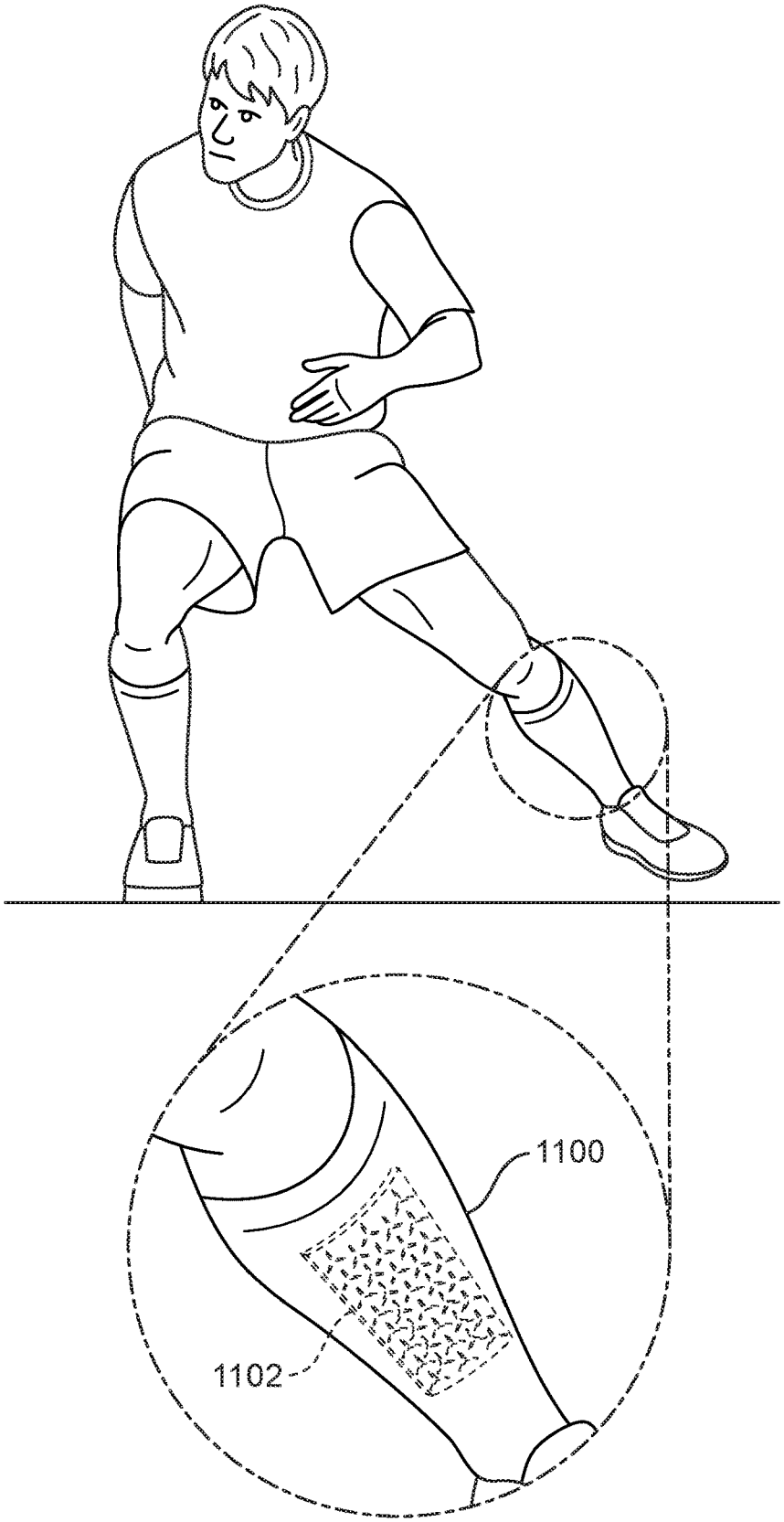
FIG. 28 is a schematic view of an embodiment of an auxetic bladder incorporated into a shin guard.
Figure 29:
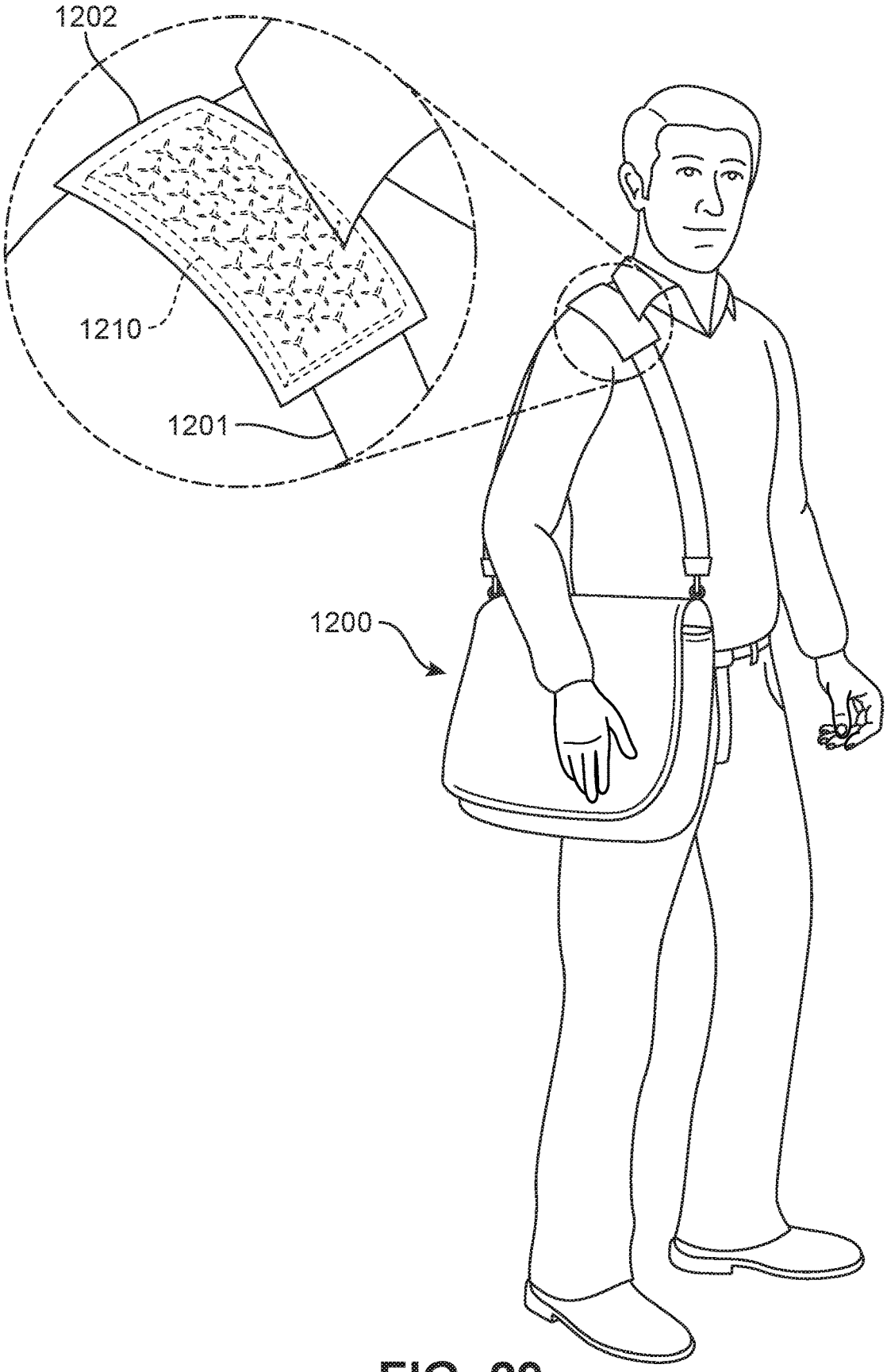
FIG. 29 is a schematic view of an embodiment of an auxetic bladder incorporated into a pad on a shoulder strap of a bag.
Figure 30:
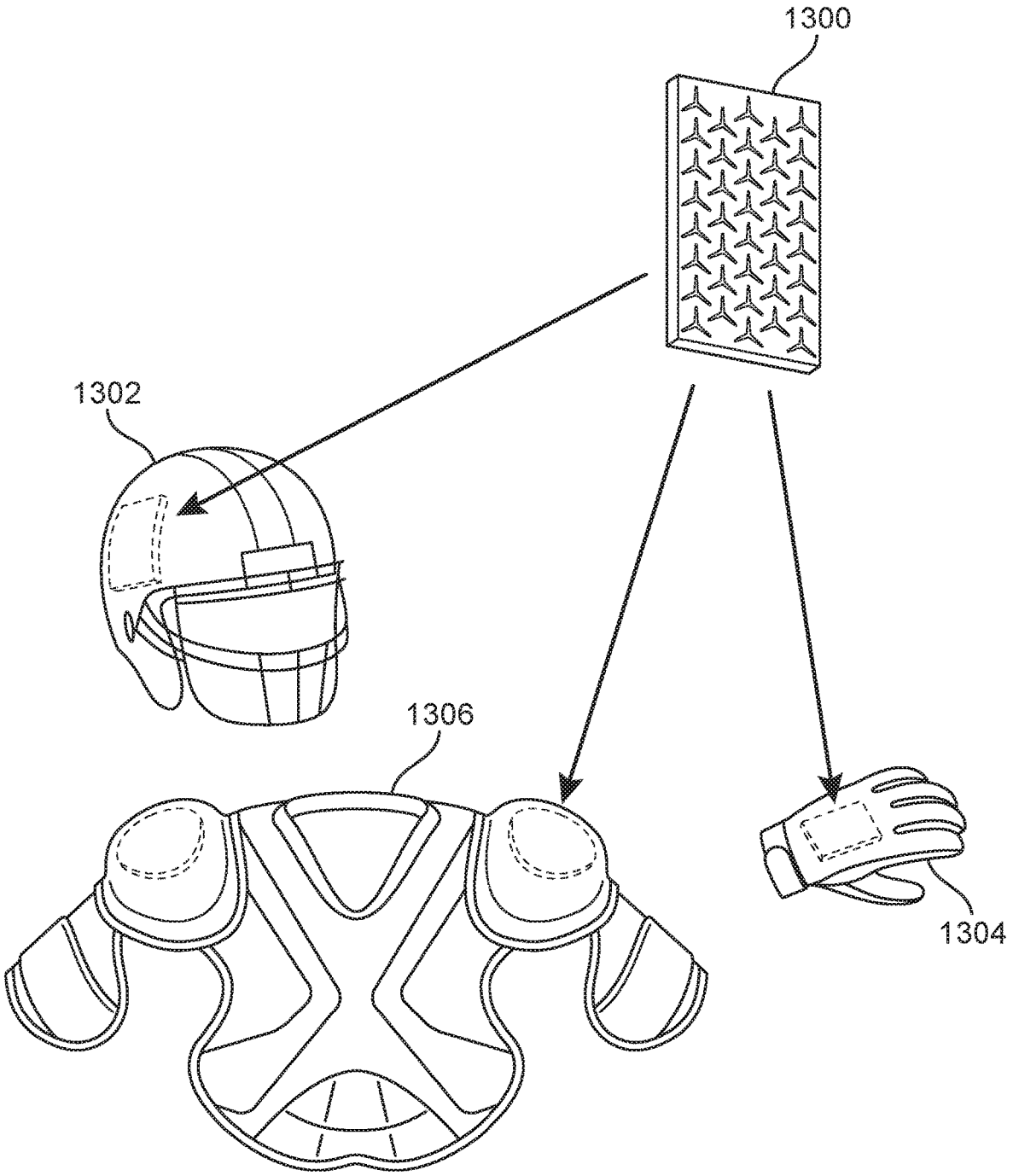
FIG. 30 is a schematic view of several protective components that may incorporate an auxetic bladder.

FIGS. 28-30 illustrate a variety of different articles and/or equipment that can be configured with a bladder member having an auxetic configuration. Referring first to FIG. 28, in one embodiment a bladder member 1100 with an auxetic configuration may be incorporated into a shin guard 1102, or similar padding element. In this case, shin guard 1102 may have an approximately rectangular geometry and bladder member 1100 may likewise be provided with a corresponding rectangular geometry. In some cases, shin guard 1102 may have pockets for easy insertion/removal of bladder member 1100. In other cases, bladder member 1100 may be non-removably disposed within shin guard 1102 (e.g., disposed between two layers that are sewn or otherwise bonded together).

In another embodiment, shown in FIG. 29, a shoulder strap 1201 for a bag 1200 may include a shoulder pad component 1202. Moreover, shoulder pad component 1202 may incorporate a bladder member 1210 having an auxetic configuration. Such a bladder may facilitate improved comfort when wearing strap 1201 on a shoulder. Of course, similar padded components for straps on backpacks, purses, luggage and other kinds of bags could also be provided with auxetic bladder members.

FIG. 30 illustrates several other kinds of articles, apparel, equipment and/or objects that could incorporate an auxetic bladder member. Referring to FIG. 30, an exemplary bladder member 1300 could be used with a helmet 1302, a glove 1304 and/or shoulder pad system 1306. The particular placement of a bladder member in each component can vary from one embodiment to another. Exemplary locations for auxetic bladders are depicted with dotted lines in FIG. 30.

Generally, a bladder member with auxetic properties could be incorporated into a wide variety of different articles. Examples of articles that could incorporate an auxetic bladder include, but are not limited to: footwear, gloves, shirts, pants, socks, scarves, hats, jackets, as well as other articles. Other examples of articles include, but are not limited to: protective equipment such as shin guards, knee pads, elbow pads, shoulder pads, as well as any other type of protective equipment. Additionally, in some embodiments, the article could be another type of article including, but not limited to: bags (e.g., messenger bags, laptop bags, etc.), purses, duffel bags, backpacks, as well as other articles that may or may not be worn.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A sole structure for an article of footwear, the sole structure comprising:

a midsole having an inflated auxetic bladder that defines at least two fluidly isolated internal volumes, wherein each of the at least two fluidly isolated internal volumes is formed from a plurality of fluidly-connected inflated components;

the auxetic bladder further including a plurality of apertures extending through a thickness of the bladder, wherein each aperture of the plurality of apertures is fluidly isolated from each of the at least two fluidly isolated internal volumes; and wherein an arrangement of the plurality of apertures and the plurality of fluidly-connected inflated components across the bladder provides the midsole with an auxetic property.

2. The sole structure of claim 1, wherein each of the at least two fluidly isolated internal volumes are inflated to a different internal pressure.

3. The sole structure of claim 1, wherein the inflated components are inflated polygonal components.

4. The sole structure of claim 3, wherein adjoining inflated polygonal components are fluidly connected to each other at their common vertices.

5. The sole structure of claim 1, wherein the inflated auxetic bladder includes a heel bladder member that has an auxetic structure in a heel region of the midsole and a forefoot bladder member that has an auxetic structure in the forefoot region of the midsole.

6. The sole structure of claim 1, wherein each of the at least two fluidly isolated internal volumes are inflated with one of air and nitrogen.

7. The sole structure of claim 1, further comprising an outsole affixed to the midsole.

8. The sole structure of claim 1, wherein each of the plurality of apertures has a three-pointed star cross-sectional geometry.

9. A sole structure for an article of footwear, the sole structure comprising:

a midsole having an inflated auxetic bladder that defines at least two fluidly isolated internal volumes, wherein each of the at least two fluidly isolated internal volumes is formed from a plurality of fluidly-connected inflated components;

the auxetic bladder further including a plurality of star shaped apertures, each star shaped aperture extending through a thickness of the bladder and surrounded by a subset of the inflated components, wherein each aperture is fluidly isolated from each of the at least two fluidly isolated internal volumes;

wherein an arrangement of the plurality of apertures and the plurality of fluidly-connected inflated components across the bladder provides the midsole with an auxetic property; and wherein each of the at least two fluidly isolated internal volumes are inflated to a different internal pressure.

10. The sole structure of claim 9, wherein each inflated component is hingedly connected to at least one adjoining inflated component to form an auxetic structure in which the inflated components can rotate with respect to each other in a plane of the midsole.

11. The article of footwear of claim 9, wherein the at least two fluidly isolated internal volumes extend in a longitudinal direction.

12. The sole structure of claim 9, wherein each of the at least two fluidly isolated internal volumes are inflated with one of air and nitrogen.

13. The sole structure of claim 9, further comprising an outsole affixed to the midsole.

14. The sole structure of claim 9, wherein the inflated components are inflated polygonal components that are fluidly connected to each other at common vertices.

* * * * *